United States Patent [19]

De Graw et al.

[11] Patent Number: 4,585,562

[45] **Date of Patent: * Apr. 29, 1986**

[54] SELF-CONTAINED SEWAGE WASTE DISPOSAL SYSTEM

[75] Inventors: Kenneth J. De Graw, Montvale; William R. Bocchini, Wycoff; Brian Wilcockson, Wayne; Armen Bogossian, Teaneck; Robert J. Uhl, Wayne; Earl E. Nause, Bellville; Ernest R. Ramirez, Far Hills, all of N.J.

[73] Assignee: American Standard Inc., New York, N.Y.

[ * ] Notice: The portion of the term of this patent subsequent to Jul. 19, 2000 has been disclaimed.

[21] Appl. No.: 578,364

[22] Filed: Feb. 8, 1984

Related U.S. Application Data

[62] Division of Ser. No. 320,654, Nov. 12, 1981, Pat. No. 4,519,103.

[51] Int. Cl.[4] ..... B01D 17/12; C02F 1/00

[52] U.S. Cl. ..... 210/805; 210/97; 210/106; 210/123; 210/138; 210/196; 210/232; 210/386; 210/400; 210/806; 4/318

[58] Field of Search ..... 210/196, 138, 106, 805, 210/748, 806, 116, 97, 123, 232, 386, 400; 4/318

[56] References Cited

U.S. PATENT DOCUMENTS

| | | | |
|---|---|---|---|
| 2,885,080 | 5/1959 | Goldman | 210/400 |
| 3,812,971 | 5/1974 | Yamamoto | 210/386 |
| 3,964,108 | 6/1976 | Lissan | 4/300.2 |
| 3,995,328 | 12/1976 | Carolan et al. | 4/316 |
| 4,013,054 | 3/1977 | Balsley et al. | 123/519 |
| 4,014,767 | 3/1977 | Schmidt | 204/152 |
| 4,056,856 | 11/1977 | Reid et al. | 4/326 |
| 4,063,315 | 12/1977 | Carolan et al. | 4/316 |
| 4,083,067 | 4/1978 | Lieb et al. | 210/104 |
| 4,096,062 | 6/1978 | Myreen et al. | 210/400 |
| 4,111,801 | 9/1978 | Jay et al. | 210/400 |
| 4,137,169 | 1/1979 | El-Hindi | 210/400 |
| 4,177,141 | 12/1979 | Nakamura et al. . | |
| 4,185,340 | 1/1980 | Sargent et al. | 4/300 |
| 4,229,202 | 10/1980 | Mullerheim et al. | 210/170 |
| 4,295,734 | 10/1981 | Tsuda et al. | 55/385 E |
| 4,310,414 | 1/1982 | Lux | 210/400 |
| 4,341,629 | 7/1982 | Uhlinger | 210/138 |
| 4,393,524 | 7/1983 | Briner et al. | 210/499 |
| 4,433,443 | 2/1984 | De Graw | 4/318 |
| 4,448,683 | 5/1984 | Green | 210/106 |

*Primary Examiner*—Barry S. Richman
*Assistant Examiner*—Titus B. Ledbetter, Jr.
*Attorney, Agent, or Firm*—Hoffmann, Dilworth, Barrese & Baron

[57] ABSTRACT

A self-contained sewage waste disposal system including a housing structure and a toilet bowl adapted to receive human waste and fluid for diluting the waste, transporting the waste and rinsing the bowl. A removable filter cassette is in the housing in communication with the toilet bowl. The bowl is flushed and the contents are dumped into the filter cassette and the bowl is subsequently refilled. Filters in the cassette separate the coarse and fine particles of solid material from the fluid received from the bowl. The solid material is stored in the cassette in a compact manner for subsequent disposal upon removal of the cassette. Fine filtering and decoloring is accomplished by a carbon canister. A reservoir is provided for storage of fluid after removal of solid material therefrom in the cassette. Pumps and interconnected conduits are in the housing to transport fluid from the interior of the system to fill the bowl after a flush and to transport filtered fluid from the filter cassette to a position for recirculation and to the reservoir. Controls are provided to pass the fluid through the system to facilitate the collection and disposal of sewage waste within the system in a predetermined sequence.

16 Claims, 24 Drawing Figures

FIG.7
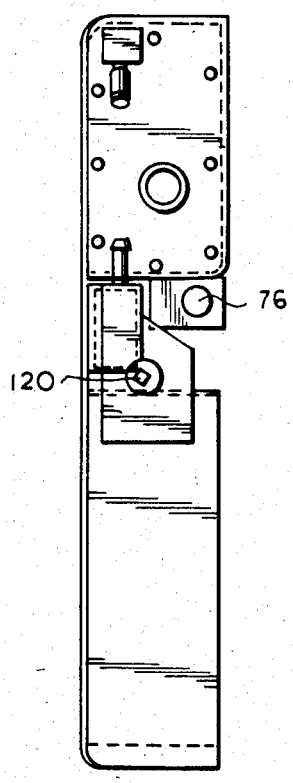
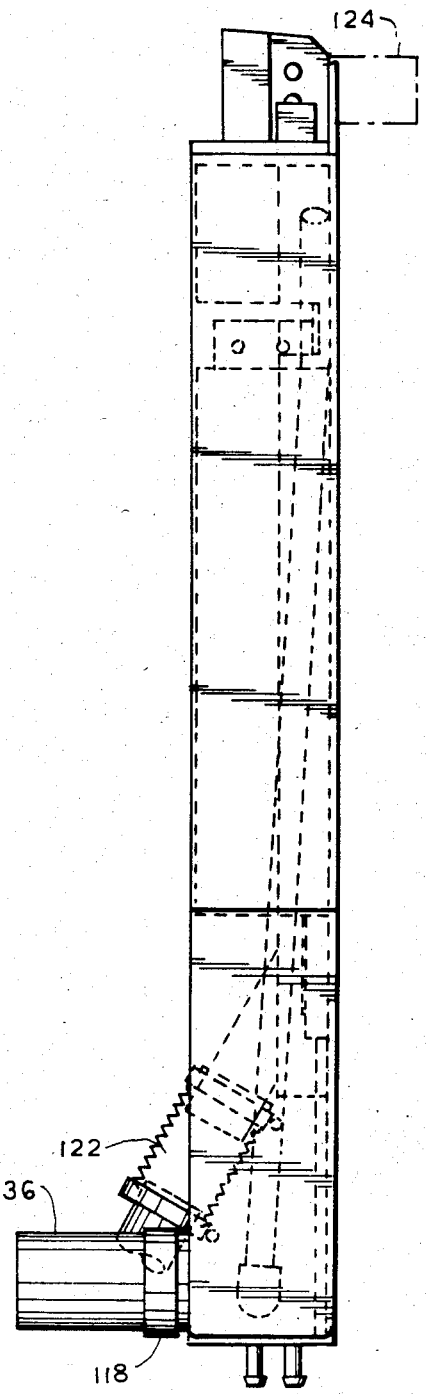
FIG.6

FIG. 11
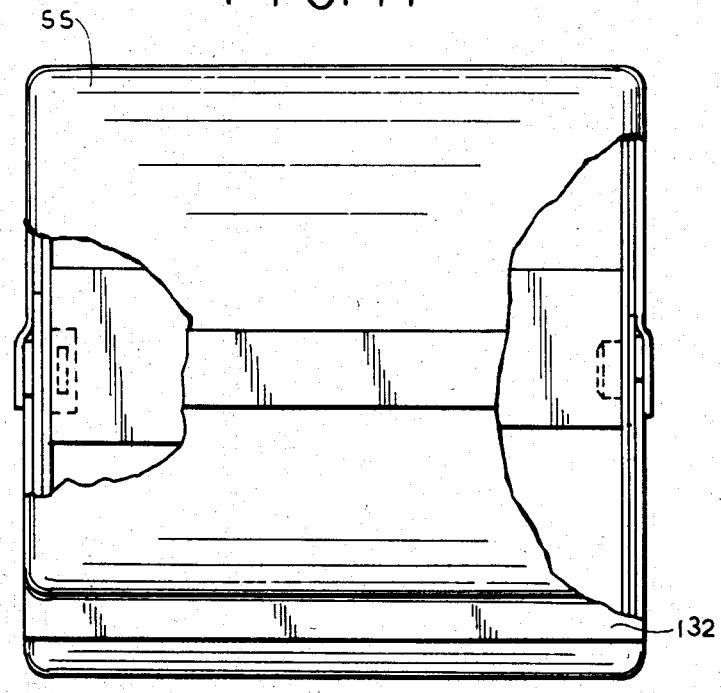
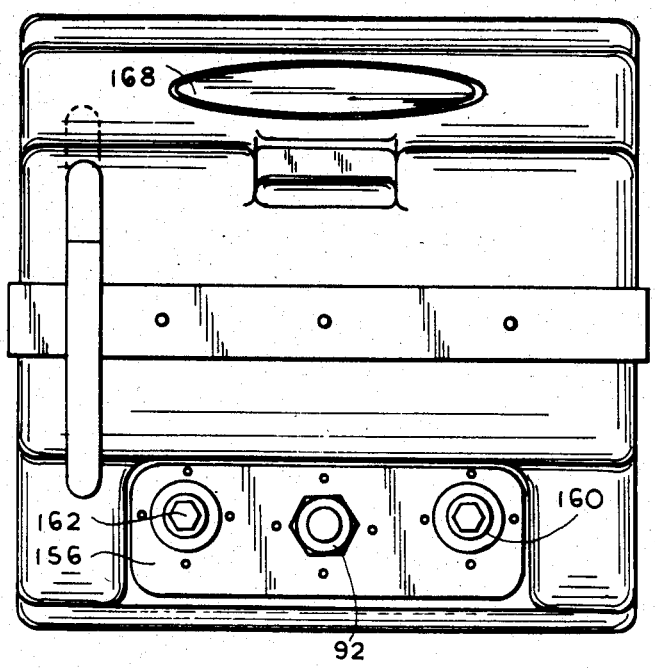
FIG. 12

SELF-CONTAINED SEWAGE WASTE DISPOSAL SYSTEM

This is a divisional of co-pending application Ser. No. 320,654 filed Nov. 12, 1981, now Pat. No. 4,519,103.

BACKGROUND OF THE INVENTION

Marine sanitary devices in particular and waste disposal systems in general have been proceeding through an evolutionary process for a number of years. The Environmental Protection Agency (EPA) has issued various specifications regarding requirements for processing liquid and solid human waste as set forth in 33 C.F.R. 159 Sewage or waste disposal basically requires that, under certain circumstances, substantially all of the solid waste must be removed from any liquid discharged from a vessel. An additional requirement of EPA is to reduce the fecal u coliform bacteria to less than 200 per 10 milliliters. In many instances recirculation of the fluid, for example water, is desirable.

Separation of solid waste and collection can be accomplished in a variety of different well known manners. The difficulty resides in storage and disposal. Clearly improvements in this area are necessary particularly when stringent EPA sanitary regulations are taken into consideration and criteria such as size, cost and efficiency of operation are kept in mind.

Two effective systems are disclosed in copending application Ser. No. 320,595 filed on 11-12-1981 and copending application Ser. No. 320,599 filed on 11-12-81 In addition to the general concerns discussed above, certain specific applications raise other concerns. For example, certain uses might bring forth circumstances where filtered fluid can be again recontaminated by contacting separated waste material. This can occur when the system is adapted for use in a marine environment and the vessel is subjected to severe pitch and roll. Thus, optimum systems for that environment would desirably include means for directing the filtered fluid immediately away from an area where it might contact the separated solid waste and to an area of storage where it is isolated from the separated solid waste.

Additionally, in many environments, disposal of the filtered fluid from the system is denied either by legal requirements or otherwise. Thus, the system should be adapted for use as a completely closed system with the fluid continuously recirculating and stored after use. Thus the system should be versatile in that it can be used in areas which permits discharge of filtered fluid and in those areas which do not permit discharge of filtered fluid.

SUMMARY OF THE INVENTION

With the above background in mind, it is among the primary objectives of the present invention to provide a system for processing liquid and solid human waste in a manner consistent with the stringent requirements of the EPA. The system includes a self-contained unit including a removable disposal filter media cassette designed to achieve "white glove" servicing of the system. The system is compact and the cassette can be interconnected with a toilet bowl and packaged beneath the toilet bowl in a compact arrangement which is particularly useful in confined areas, for example in marine use.

It is also an objective to utilize low cost filtration materials to achieve minimum cost per flush of the system. Also, the system is energy efficient and only a small amount of electrical power is required for use. The initial fill includes a salt addition. The system requires no other chemical additions for sanitizing purposes.

A unique two stage filtration process is incorporated in the cassette for improved initial phase separation. In fact, a flow-through system is provided that satisfies United States EPA requirements for suspended solids produces an effluent having an arithmetic means of fecal coliform bacteria count not greater than 200 per 100 ml and suspended solids not greater than 150 mg. (milligrams) per liter when used in environments where the filtered fluid is eventually discharged from the system. Additionally, the system is designed for use in environments where treated sewage or any waste derived from sewage must be retained and discharge to the environment is not permitted.

A further objective of the present invention is to provide an improved self-contained sewage treatment system in which the solids are effectively filtered from the fluid and the filtered fluid is thereafter retained separate from the collected solids to prevent recontamination. This is accomplished by a uniquely designed filter cassette in which the waste solids are effectively separated from the fluid and a separate reservoir into which the filtered fluid is directed for storage and reuse or disposal as required.

Still a further objective of the present invention is to provide a self-contained filtering system in which the filtered fluid can be recirculated for a predetermined period of time to increase the filtering effectiveness of the system and provide a high quality filtered fluid for reuse or discharge from the system as an effluent acceptable to EPA standards.

The system is designed to provide separate pumps for rinse and refill and for removal of filtered fluid from the cassette to the reservoir or for recirculation through the system for a predetermined period of time and ultimate storage in the reservoir. The fluid stored in the reservoir is naturally in condition for use in a later rinse and refill cycle. Thus, the system is entirely self-contained. In fact, the reservoir is used as a storage container for the filtered fluid. In those environments where discharge from the system is not permitted, the reservoir can be easily connected to a holding tank to receive effluent fluid and where acceptable the reservoir is adapted to discharge filtered effluent fluid to the environment.

Two way valve mechanisms are employed in the system to direct fluid through the various conduit paths for recirculation of fluid for further filtering purposes, and directing the fluid into and out of the storage reservoir.

It is contemplated of the present invention that storage of the fluid in a separate container from the filter cassette in which the filtered solid waste is collected and stored alleviates the danger of recontamination of the fluid through contact with the separated solid waste. This is particularly useful under agitation condition, for example, the pitch and roll encountered in a marine type vessel. Furthermore, the filter cassette is designed with a configuration which facilitates separation of the filtered fluid within the cassette when the solid waste material is first removed and until the filtered fluid can be directed out of the filter cassette into the reservoir.

In the system, a removable and disposable filter cassette acts in cooperation with a toilet bowl and a reservoir. The cassette is designed to roll a filter material about a spindle or take up roll assembly. Solid waste material is separated and rolled up into the take up roll. Two stage filtration is accomplished by first screening out or projecting out with the aid of a flapper the majority of the solid waste ingredient. A second stage of solids removal is achieved with a filter media such as an unwoven plastic fabric. The two stage filter material method employs one roll of screen and one roll of filter media positioned adjacent to one another and adapted to be rolled together onto the take up roll. A first stage of separation through the screen material removes approximately 97 percent of the solids from the fluid. The majority of the remaining three percent of the solids is collected by the second stage filter in the form of the filter media. When the filter is fully rolled up it can be replaced by removing the filter cassette and replacing it with a new one. The removed filter cassette can then be disposed of in a simple, clean and efficient manner. The configuration of the cassette is such that the filtered fluid is directed away from the separated solid waste material and is quickly and efficiently pumped from the cassette to a separate reservoir. The fluid can be recirculated through the system including the cassette for a predetermined period of time for further filtering before transmitting the fluid ultimately to the reservoir for storage and reuse or disposal as effluent fluid.

The take up roll has a polyagonal configuration, for example triangular, which facilitates directing the larger portion of the solid waste on the filter material with the material wrapping around the roll for collection and storage.

A further objective of the present invention is to provide a system with unique controls, a unique arrangement of pumps, valves and interconnected conduits to facilitate a predetermined and timed sequence of operations for the self-contained sewage waste disposal system. The system is designed so that the toilet bowl is rinsed and refilled, the flushed fluid containing solid waste is passed through a filter cassette where the solid waste is substantially entirely removed and the fluid waste is maintained separately from the solid waste and immediately recirculated through the filtering system for further filtration for a predetermined period of time and transferred to a reservoir for storage and reuse in the system.

Appropriate sensors are provided to indicate a level of fluid within the filter cassette to cause the fluid to be pumped out of the cassette either for recirculation or storage in the reservoir. Appropriate sensors are provided in the reservoir to indicate when sufficient fluid has been transferred from the reservoir to the toilet bowl for rinse and refill purposes. When the reservoir has an excess amount of fluid, the excess or effluent fluid can be expelled from the system through a gravity overflow. The reservoir is also provided with appropriate vent means.

A sanitation module is provided in the recirculation path for further filtration of the fluid. The module can be any one of a number of different types of units for the required purpose. It can be in the form of an electrolytic cell, a unit employing ozone generation, or a unit utilizing ultra violet radiation. The sanitation module can also employ chemical disinfection. For example, a hypochlorite solution, either solid or liquid, can be used. Alternatively, iodine, bromine, mecuric salt, or silver salt solutions could be used. Another type of chemical disinfection is by pH adjustment. Alternatively, the sanitation module can be one which employs heat. For example, the heat can be produced by electrical resistance, combustion or chemical reaction.

Also incorporated in this system is a decoloring cell, for example a carbon canister, for the purpose of removing color from the recirculated fluid as well as providing for fine filtration. The decoloring is achieved by activated carbon adsorption. The fine filtration is achieved through the 'deep bed effect' of the carbon particles. This cooperates with the sanitizing effect of the sanitization module which in general converts the chlorides normally found in human urine into chlorine compounds which in turn are capable of sanitizing and deodorizing the recirculated fluid.

Also contemplated as part of the system is a coloring cell located in the toilet bowl flush circuit and provided to function in the conversion of the slightly yellow tinted cloudy fluid into a masked blue solution to improve its aesthetic appearance in the bowl.

The controls for operating the system can be conventional types of electrical or pneumatic controls which conveniently provide for the desired programmed timing and sequence of operations.

The flushing mechanism for rinsing the bowl and dumping u the contents is designed to operate in two ways. If only liquid waste is within the bowl, the flush command can be given by directing the activating handle in one direction whereupon the liquid waste will be dumped and filtered without the advancement of the filter material thereafter in view of the absence of solid waste to be collected. If the flush handle is activated in a second direction a flush command is given so that the waste including solid waste is dumped into the filter cassette and the removed solid waste filtered therein is advanced on the filter material to a rolled up and stored position. Controls are provided for indicating when the filtered cassette is advanced and when it is in condition for replacement.

Suitable controls are also provided to replace the filter cassette and carbon canister without dismantling or substantially affecting the remainder of the system. Replacement can be accomplished in a quick, efficient and clean manner.

The present system is capable of being utilized in marine environments, camping sites, construction locations, mobile vehicles, and other similar places where self-contained waste disposal systems are applicable.

In summary, a self-contained sewage waste disposal system is provided. The system includes a housing structure for a toilet bowl adapted to receive human waste and fluid for diluting the waste, transporting the waste and rinsing the bowl. A removable filter cassette is positioned in the housing in communication with the toilet bowl. Means is provided for flushing the bowl and dumping the contents into the filter cassette and for subsequent refilling of the bowl. Filter means in the cassette separates the coarse and fine particles of solid material from the fluid received from the bowl. Storage means in the cassette stores the solid material in a compact manner for subsequent disposal upon removal of the cassette. A reservoir is provided for storage of fluid after removal of solid material therefrom in the cassette. Pump means is provided including interconnected conduits in the housing to transport fluid from the reservoir to fill the bowl after a flush and to transport filtered fluid from the filter cassette to a position for recirculation and after recirculation to a reservoir. Control means passes the fluid through the system to facilitate the collection and disposal of sewage waste within the system in a predetermined sequence.

With the above objectives among others in mind, reference is made to the attached drawings.

BRIEF DESCRIPTION OF THE DRAWINGS

In The Drawings:

FIG. 6 is a side elevation view thereof;

FIG. 7 is a top plan view thereof;

FIG. 11 is an end elevation view thereof from the opposite end;

FIG. 12 is an end elevation view thereof from the opposite end;

DETAILED DESCRIPTION

System 20 as shown includes a compact housing structure 22 which provides a decorative and attractive enclosure for the system components as well as providing a weight support contoured for the user. All of the components of system 20 are incorporated within the housing and thus it is an entirely self-contained system designed for disposal of sewage waste. In this manner, it is particularly useful in the marine environment and more so since it will satisfy certain stringent EPA requirements for handling of human waste.

Figure 5:
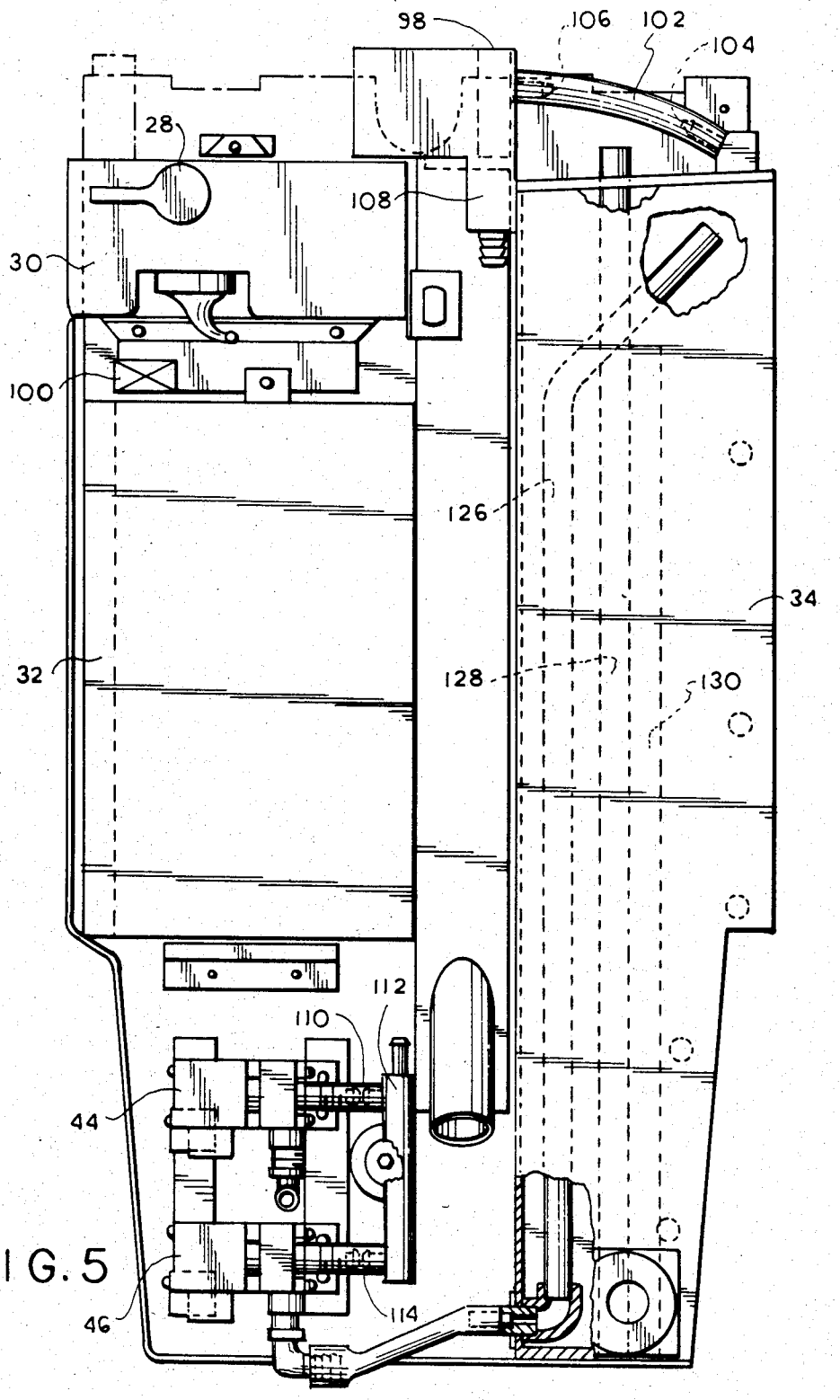
FIG. 5 is a front elevation view of the back housing portion of the system.

System 20 is shown in its entirety in FIGS. 1–4 with the basic parts of the system within housing 22. The housing 22 can be divided into two major subassembly components, a back housing subassembly 24 and a lower housing subassembly 26. The major components contained in back housing subassembly 24 includes a two position flush handle 28, an electrohic control panel or module 30, a carbon canister 32, and a fluid reservoir 34 including an integral pump 36. Details of the back housing assembly 24 can be best seen in FIGS. 5–7 depicting that subassembly.

The lower housing 26 forms the support for a toilet bowl 38, for example of vitreous china or other conventional substitute therefor, and contains as other major components an electromagnetic flush valve 40, a processing or recirculation pump 42, two-way valves 44 and 46, cassette filter drive mechanism 48, and the electrolytic cell 50.

The third major subassembly is the replaceable cassette assembly 52 which contains the solids separation screen 54 formed of a coarse filter material, an effluent filter 56 of fine filter media, and a take up mechanism 58.

As shown in FIGS. 1–4 a conventional seat and cover assembly 60 is positioned on the housing and is aligned with bowl assembly 38.

There are other components within the upper housing assembly 24 and lower housing assembly 26 as well. For example, the upper housing assembly 24 includes a front access panel 61 which is removably fastened to the upper housing in a conventional manner to permit access to the contents thereof. A cassette drive motor 62 is mounted in the lower housing subassembly 26 in position to engage and drive the cassette take up roll.

A fitting 64 is positioned through the hole 66 of a vessel on which the system is mounted for connection of a vent hose 68 to vent the system.

Appropriate brackets 18 are provided to mount the bowl within the lower housing 26. There are 2 brackets used to mount the seat, cover, and bowl to the housing and they are located at the rear of the seat. (see FIG. 4). An appropriate gasket seal 70 is provided where the bowl is mounted to the housing.

Adjacent to flush handle 28 are a pair of indicator lights. The upper light 72 is a "do not flush" indicator and can be colored coded for example yellow. Similarly, the lower light 74 can be colored coded for example red to act as a "change cassette" indicator.

A coloring chamber 76 is provided for producing a mask color for the recycled fluid to be returned to the bowl. A vent tube 78 is centrally located in the upper housing portion. Effluent hose connection 94 and drain hose connection 95 extend downwardly and outwardly from the housing to facilitate removal of fluid from the system.

Sump fluid level electrodes 80 and 82 are provided in the base of the cassette 52 for activating and deactivating the pump means to remove fluid from the cassette after it has been filtered therein. The take up mechanism 58 within the cassette 52 includes a polygonal solids take up roll 84, for example triangular in configuration as shown. A coarse solids separator roll 86, a fine solids filter roll 88, a filter advance control 90, and a fluid disconnect 92 are also in the cassette 52.

Further specific details of the back housing 24 including the elements housed therein are shown in detail in FIGS. 5–7. The reservoir 34 and the carbon canister 32 are arranged side by side as the back housing assembly is viewed in the vertical position. Between these two elements is the vent tube assembly 96. A manifold 98 for vent tube assembly 96 is positioned at the upper end of the upper housing. Conventional disconnects 100 are provided for the carbon canister 32 to facilitate its removal and replacement, generally at the same time as replacement of the filter cassette is accomplished. Hose 102 extends from the manifold 98 to a barbed hose fitting 104 of conventional nature on the upper end of reservoir 34. The other end of hose 102 is similarly mounted to a barbed fitting 106 extending from the manifold 98. An anti-siphon block 108 extends downwardly from manifold 98 into vent tube 96. Hose 110 is fitted to valve 44 and to a manifold 112 and similarly, hose 114 is fitted between manifold 112 and valve 46. Valve 46 is connected to reservoir 34 by means of hose 116. Pump 36 is integrally mounted to reservoir 34 by means of pump adapter 118. A vent plug 120 is positioned in the upper end of manifold 98. The vent hose 122 extends outwardly from the bottom end of the reservoir and a vent hose adapter 124 is mounted in the upper end portion of the back housing 24. The coloring cell or coloring chamber 76 is located in the upper central portion of the back housing assembly.

On the interior of the reservoir are the refill tube 126 the electrode stock tube 128 and the effluent overflow tube 130. In the above manner, the interconnection of the various components of the upper back housing assembly 24 is achieved.

Figure 1:
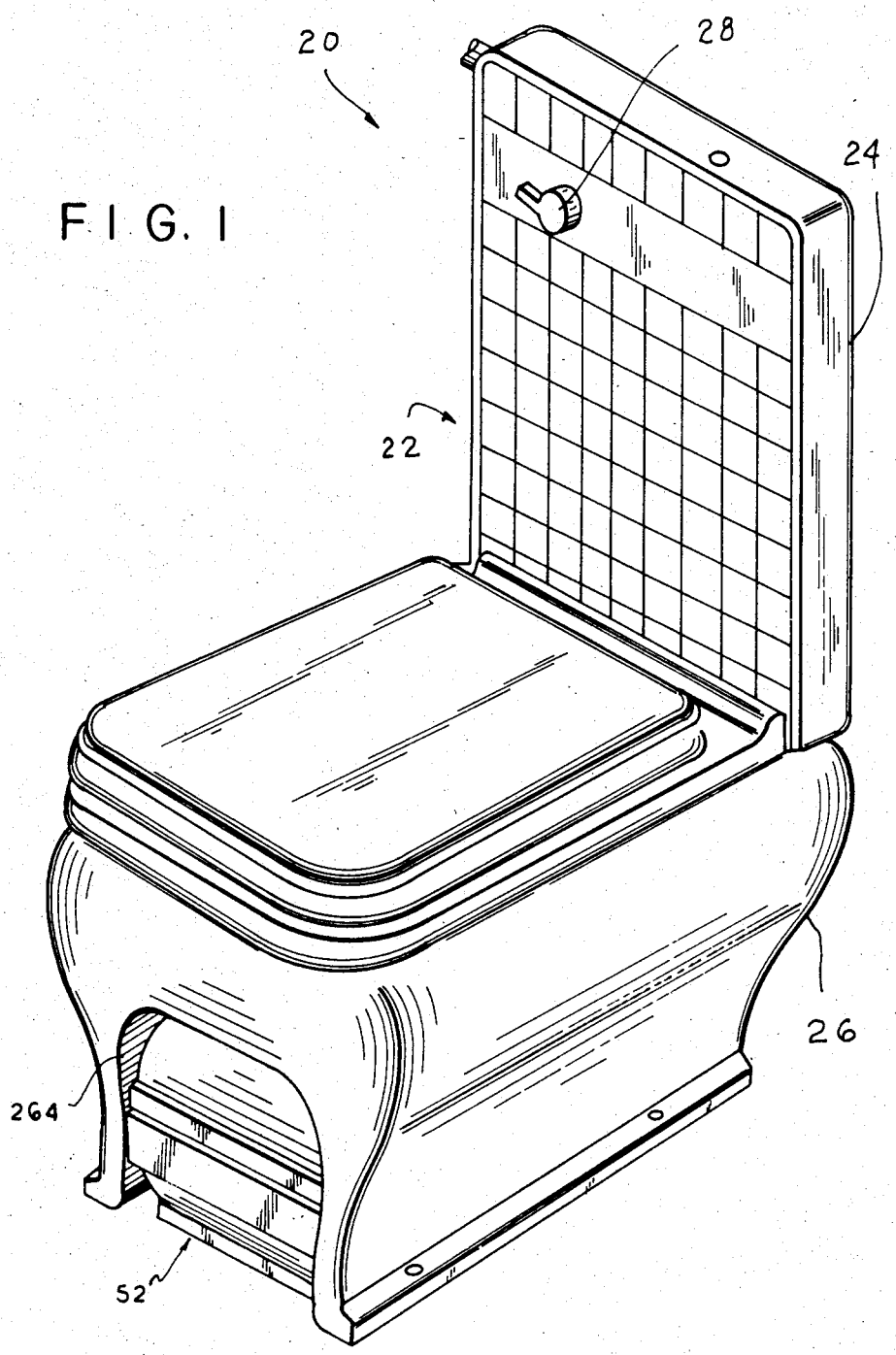
FIG. 1 is a perspective view of the self-contained sewage waste disposal system of the present invention.
Figure 2:
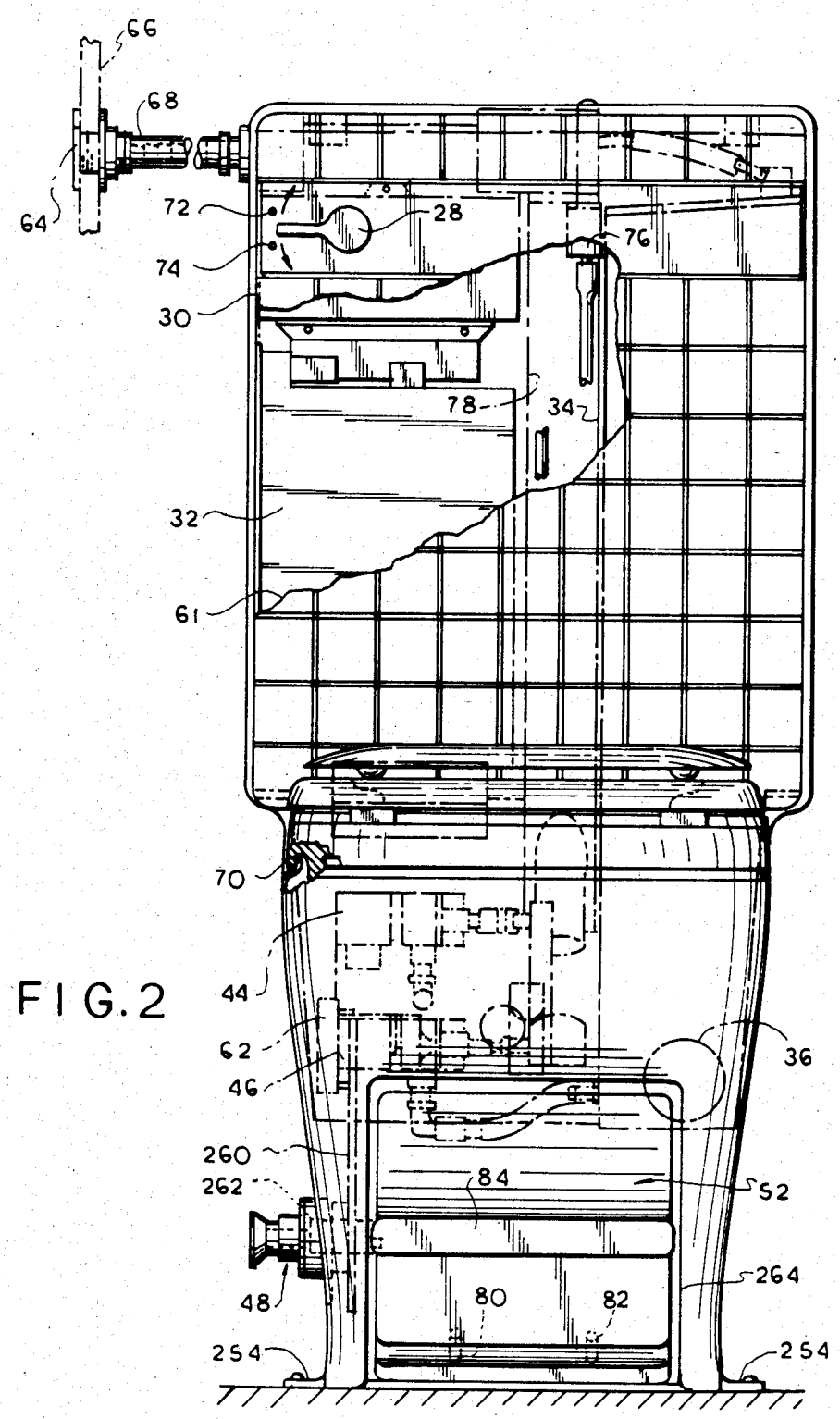
FIG. 2 is a front elevational view thereof with portions broken away and removed.
Figure 3:
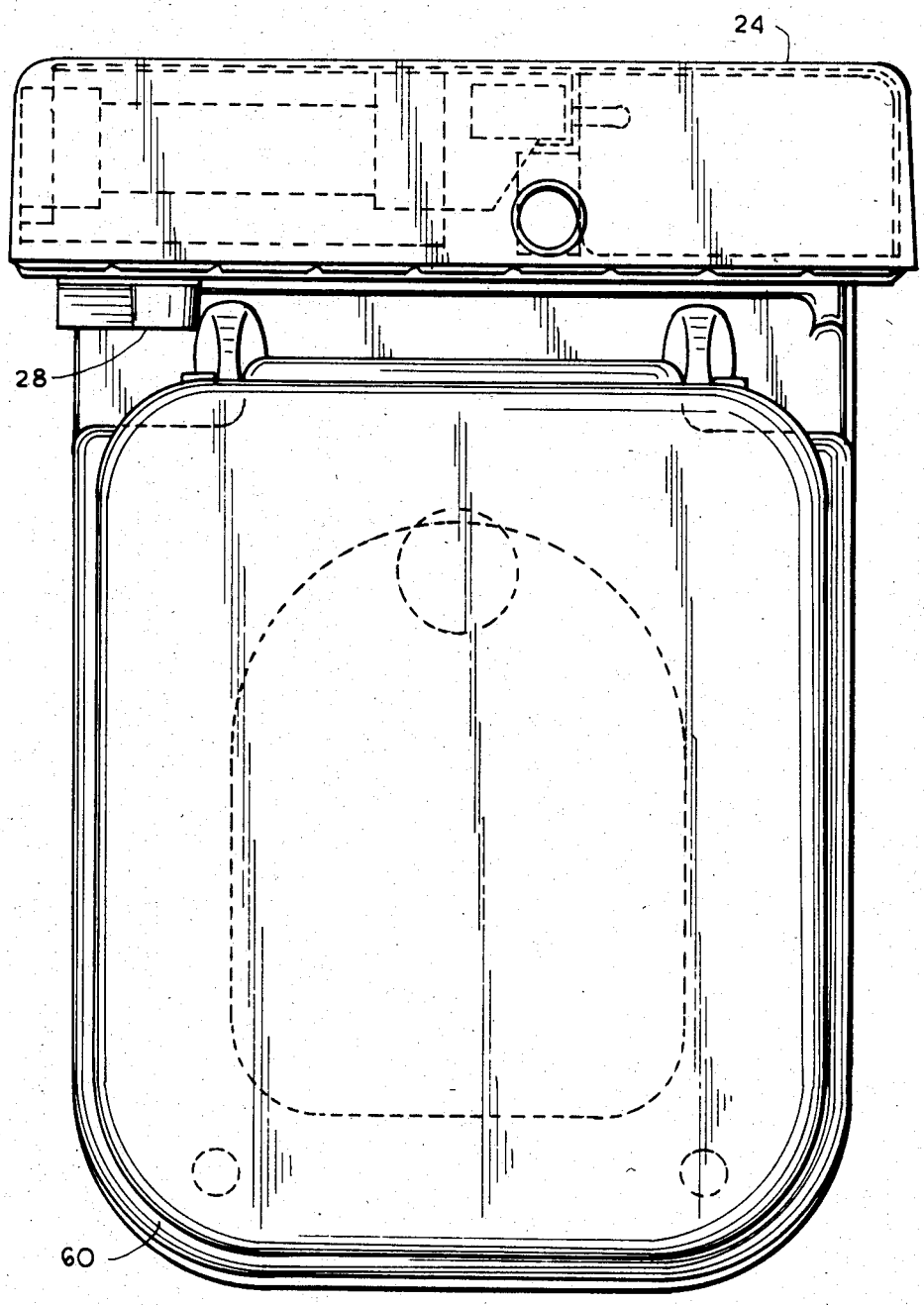
FIG. 3 is a top plan view thereof.
Figure 4:
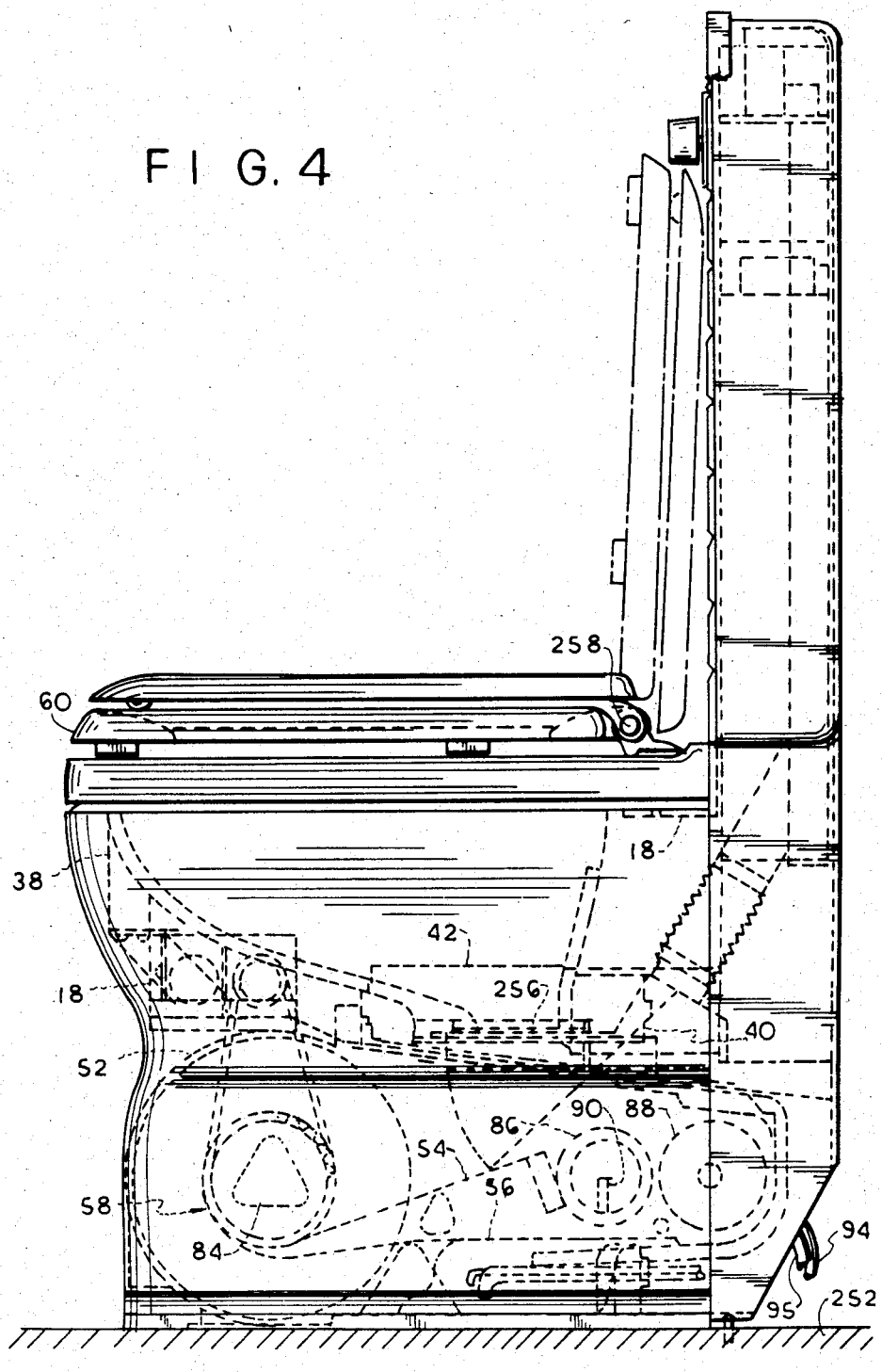
FIG. 4 is a side elevational view thereof.
Figure 8:
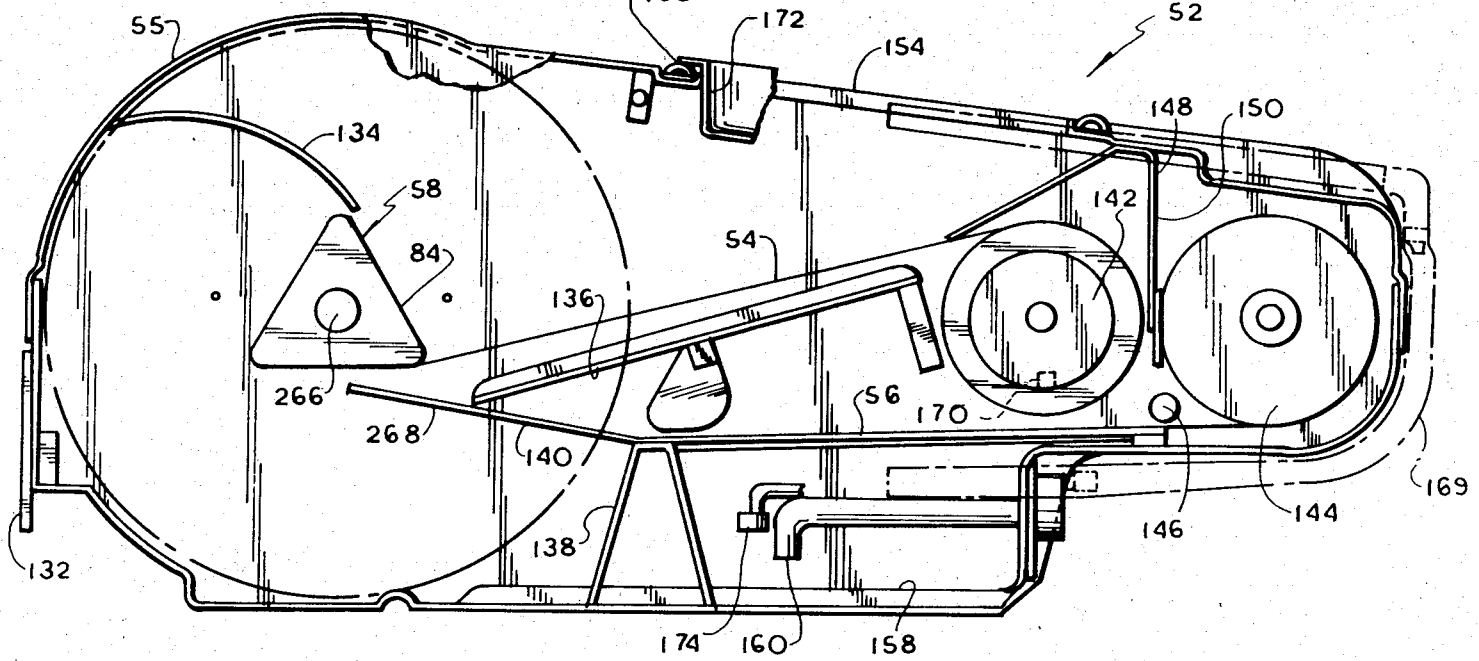
FIG. 8 is a sectional elevation view of the filter cassette assembly portion of the system.
Figure 9:
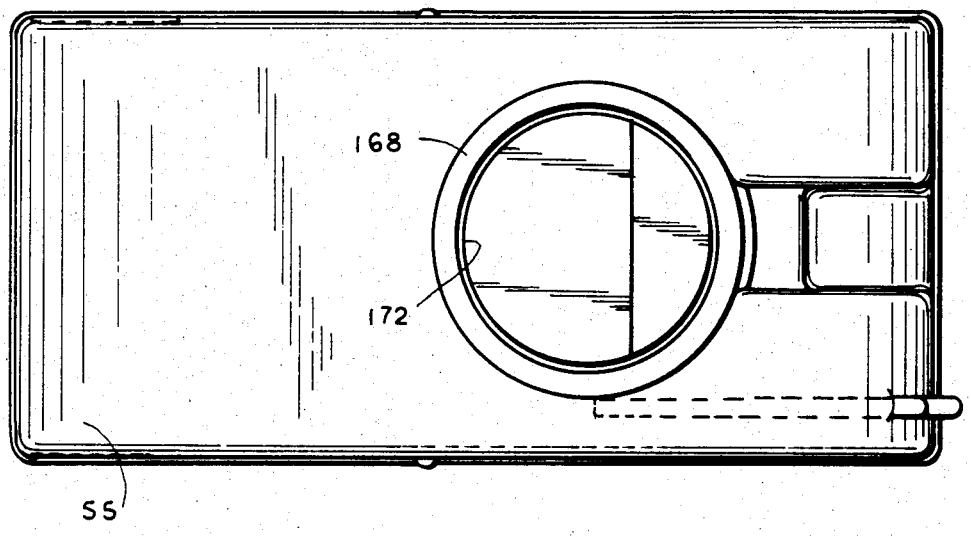
FIG. 9 is a top plan view of the filter cassette assembly portion of the system.
Figure 10:
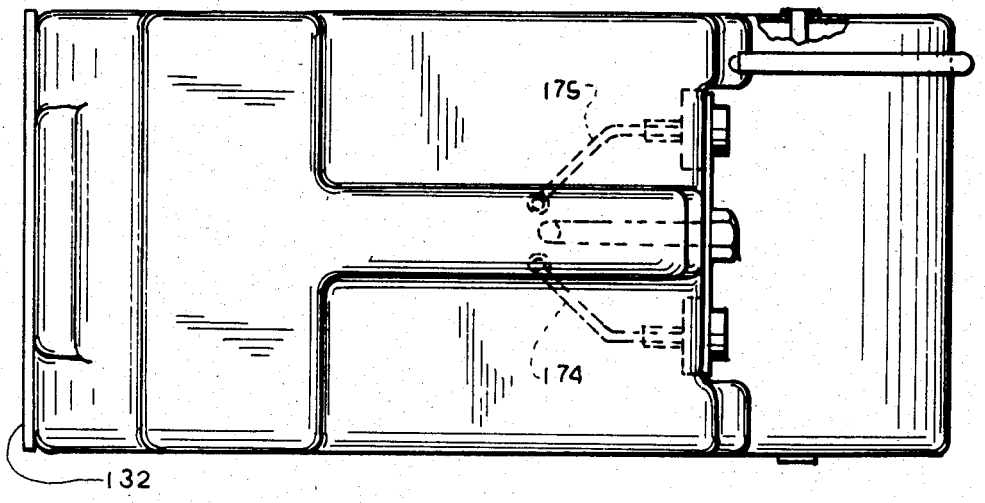
FIG. 10 is a bottom plan view thereof.

The details of the replaceable cassette assembly 52 can be best seen in FIGS. 8–2 of the drawings. The filter cassette assembly 52 includes an outer housing 55 having a configuration generally which facilitates its use of the least amount of size in keeping with the compact nature of the system 20. Additionally, the configuration is such that filtered fluid is separated from the danger of contamination from separated waste solids.

The housing 55 includes a handle 132 at the front end that facilitates gripping and removal of the cassette when it is ready for disposal and replacement and additionally for introducing a new cassette into position for use.

A splash guard 134 overlies the take up roll assembly 58 on the interior of the cassette and is mounted in conventional fashion on the interior structure of the housing 54 to guard against splashing and contaminating dissemination of the separated and collected waste solids. A pressure plate 136 is in position to apply pressure to the collected filter materials on the take up roll assembly 58 as the roll expands in size to facilitate retention of the waste and collected filter material on the roll and to compact the solid waste. Support ribs 138 rest on the bottom of the casino 55 and extend upward to support a filter table 140. The filter table 140 provides support for the fine filter media 56 and assists in directing that filter media onto the take up roll. The support ribs 138 are dimensioned so that they do not interfere with collection and removal of filtered fluid in the bottom of the cassette. A supply roll 142 is mounted in the cassette in a conventional manner and contains a supply of coarse filter material 54. Adjacent to the coarse filter material supply roll 142 is a fine filter media supply roll 144. Supply roll 144 contains a suitable supply of fine filter media 56. A guide roll 146 is positioned between the filter supply roll 144 and the ramp 140 to facilitate direction and guidance of the fine filter media 56 within the cassette. A somewhat U-shaped splash guard 148 is mounted on the upper side of the cassette and has two legs extending downwardly, a first leg 150 extending between the two supply rolls 142 and 144 and a second leg 152 which extends downwardly and inwardly into contact with the coarse filter material 54 coming off the suppply roll 142. Splash guard 148 helps the prevention of waste material entering through the access opening 154 in the upper end of the cassette from contacting and contaminating the filter material contained on supply rolls 142 and 144 and otherwise contaminating the portion of the cassette assembly 52 in which these rolls are mounted.

A plate stiffener 156 is mounted on the rear bottom portion of cassette assembly 52 to strengthen the area in which electrical and fluid connections are made to the cassette. The take up roll 84 is triangular in configuration to facilitate capturing and collecting of the solid waste material there around. To guard against bypassing of unfiltered fluid before removal thereof from the bottom of the cassette and possibly contaminating it with solid waste material collected on take up roll 84, a pad of fiberous filter material 158 can be positioned in the bottom of the cassette to trap any solids before entering the opening of pick up tube 160 and damaging the recirculation pump 42.

Extending through the bottom rear of the casette are conventional electrical disconnects 162 and 166 and a fluid disconnect 92.

A sealing gasket 168 extends around access opening 154 to receive the waste in the upper side of cassette 52. Tubing 169 extends from the interior of the bottom of the cassette to the exterior of the top side of the cassette and acts as a vent to facilitate gravity filtering of fluid through the fine filter 56.

A magnet 170 is on the coarse filter supply roll 142 for indicating the need for replacement of the cassette as will be described in detail below. A replacement cap 172 is frictionally mounted in access opening 154 before the cassette is used. Before the cassette is mounted in position in the system, the cap 172 is removed and waste can be introduced into access opening 154. After the cassette is removed from the system, a cap 172 can be replaced to reseal the cassette for disposal in a clean and efficient manner.

The level sensor electrodes 174 and 175 extend into the bottom of the cassette adjacent to and on either side of the opening in fluid pick up tube 160. The sensor is interconnected to the electrical system through electrical connectors 162 and 166 and indicates when the fluid level is present for subsequent recirculation or removal.

In manufacture, the cassette housing can be formed in any conventional manner such as by molding two separate pieces mounting the internal parts and then bonding the top half to the bottom half with a conventional type of adhesive or means such as weld bonding, ultrasonic welding, and the like. The unit is thus sealed and contamination is prevented.

Figure 13:
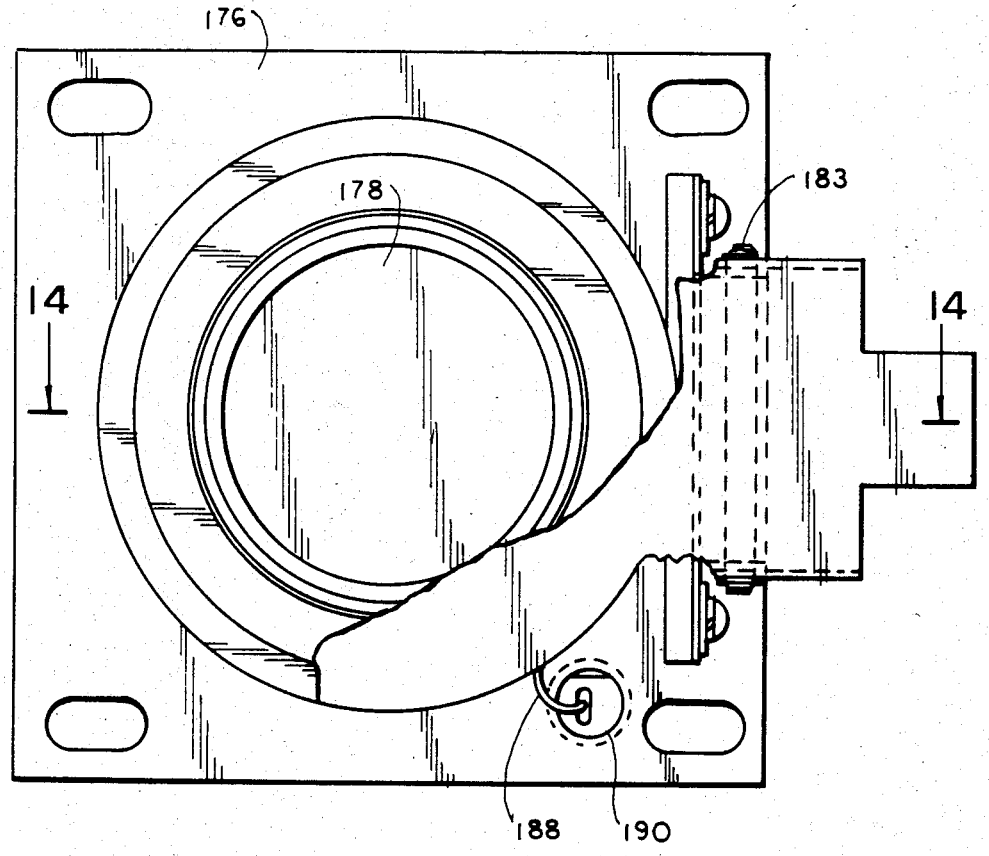
FIG. 13 is a top plan view of the flush valve assembly portion of the system with a portion thereof broken away and removed.
Figure 14:
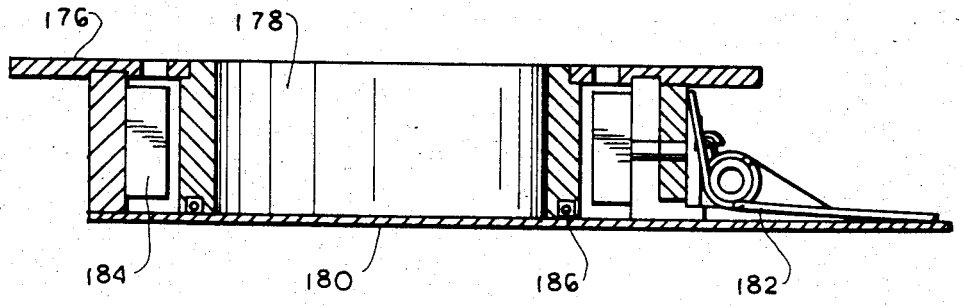
FIG. 14 is a sectional view thereof taken along the plane of line 14—14 of FIG. 13.

The details of flush valve 40 are shown in FIGS. 13 and 14 of the drawings. Flush valve 40 includes a housing 176 with a central opening 178 therethrough. The valve is of the flap valve type and includes a flapper 180 normally held in the closed position and engaged by torsion spring assembly 182 on the housing. The flapper 180 is pivotally mounted about pivot pin 183 for shifting of the valve between the open and closed positions. A conventional hinge can also be used to facilitate the mounting of the flapper on the housing for use. The valve is normally held in the closed position by means of a magnetic coil 184. When released by the electrical circuitry of the system, the magnetic coil will be deactivated permitting flapper 180 to be opened by gravity and the weight of the bowl contents. After the bowl contents are removed torsion spring 182 lifts flapper 180 in close proximity to coil 184 and thereby facilitates closing of the valve when the electrical circuitry demands it by reactivating coil 184. A conventional type of O-ring 186 is used to maintain a sealed relationship between flapper 180 and housing 176 when the valve is closed so no fluid can pass through opening 178. The electrical connection is made to coil 184 by means of wiring 188 passing through an aperture in the housing. Leakage is prevented by filling the aperture with a suitable material such as silicone sealant 190.

Figure 15:
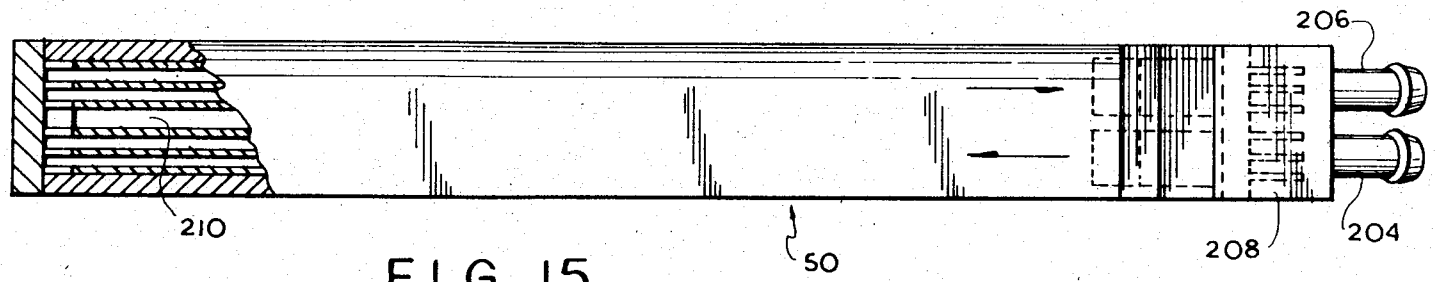
FIG. 15 is a top plan view and partially sectional view of the electrolytic cell assembly portion of the system.
Figure 16:
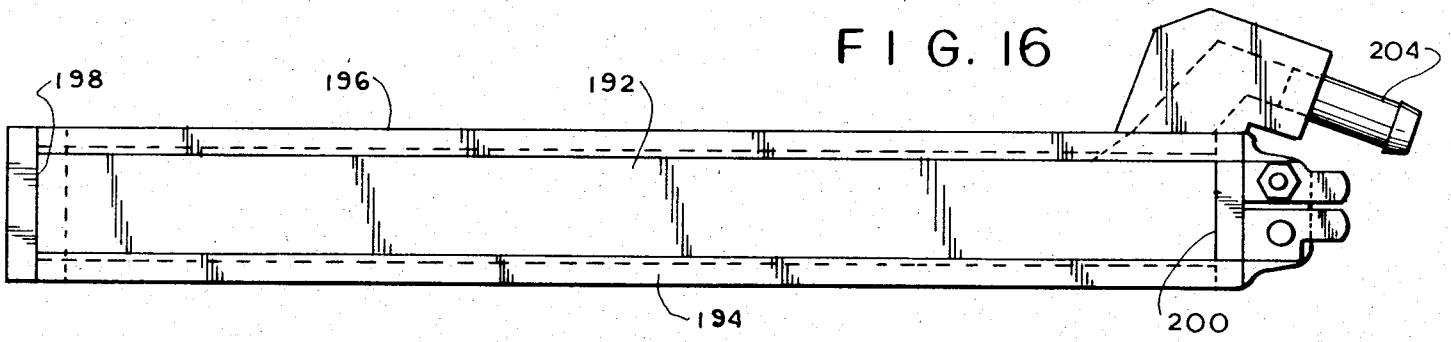
FIG. 16 is a side elevation view thereof.

The details of electrolytic cell 50 are shown in FIGS. 15 and 16 of the drawings. The cell 50 is generally rectangular in configuration and the outer housing is formed with opposing side plates 192, a bottom plate 194, a top plate 196, a rear plate 198, and a front plate 200. A fitting mount 202 extends from casing and contains therein a pair of barbed hose fittings 204 and 206, fitting 204 being for inlet of fluid and fitting 206 being for outlet of fluid as shown by the arrows in FIG. 15. An arrangement of electrodes 208 are in the casing for sensing purposes in the system. An appropriate divider 210 is in the electrolytic cell for spacing the elements on the inlet side from those on the outlet side.

Figure 17:
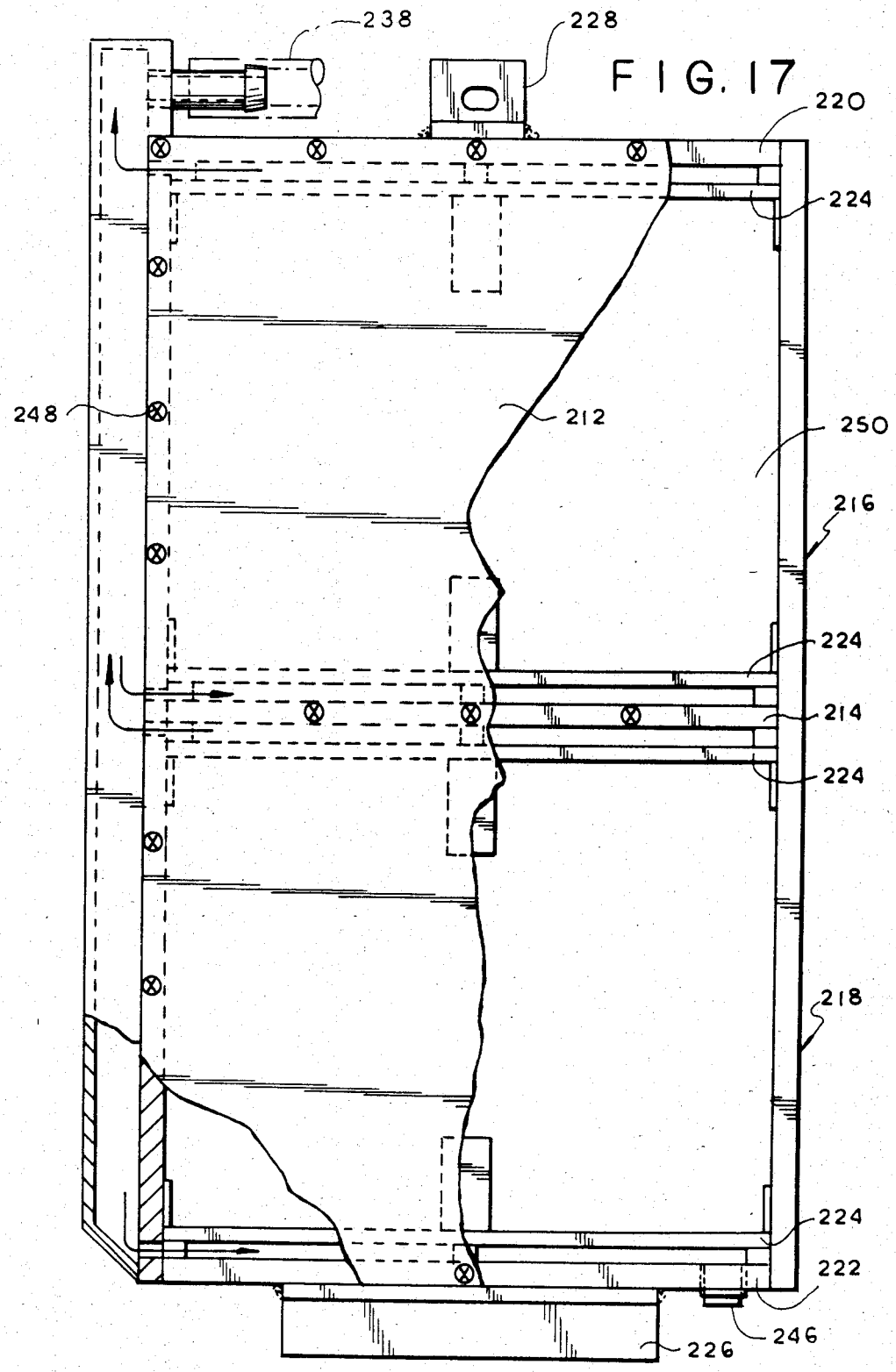
FIG. 17 is a partially sectional side elevation view of the carbon canister assembly portion of the system.
Figure 18:
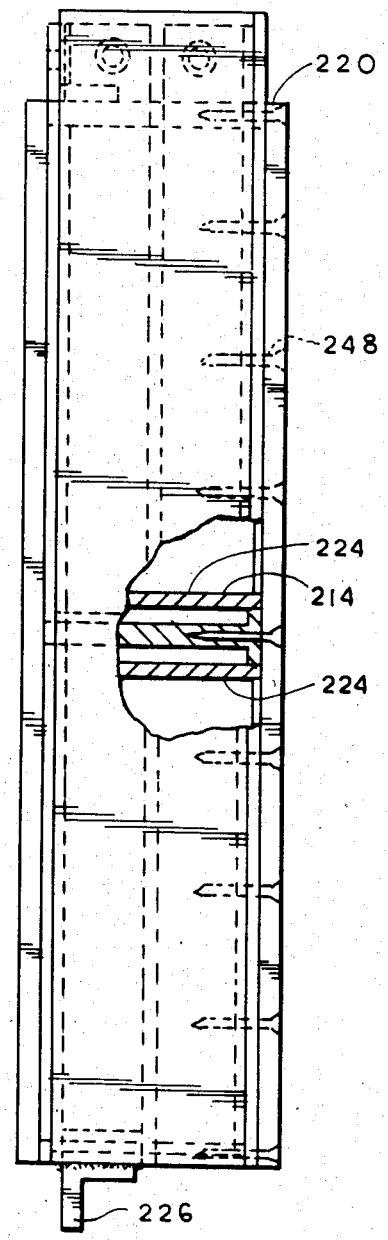
FIG. 18 is a partially sectional end elevation view thereof.
Figure 19:
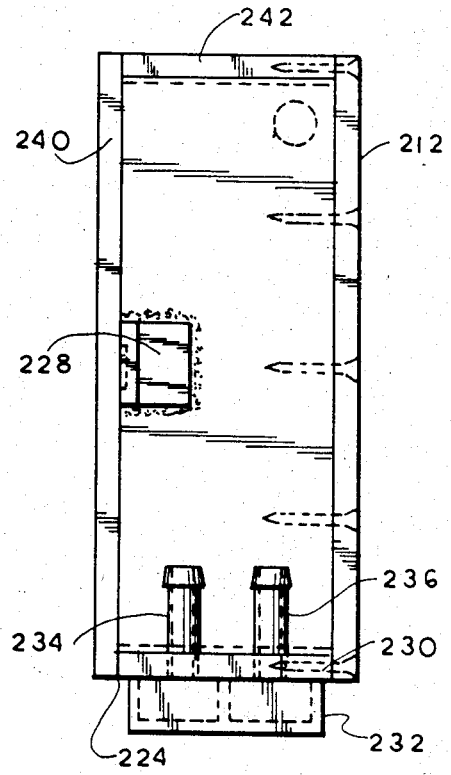
FIG. 19 is a top plan view thereof.

FIGS. 17–19 of the drawings depict the details of the carbon canister assembly 32. Canister 32 includes a cover 212. A central horizontal divider 214 separates an upper section 216 from a bottom section 218. The canister has a top plate 220 and a bottom plate 222. Support screens 224 are mounted in the upper and lower ends of both filter sections and can be mounted in a conventional fashion such as by epoxy or solvent. Each screen 224 is mounted in a frame and can be formed of a conventional screening material such as a glass fiber mesh. The mesh size is small enough to retain the carbon particles in the chamber. Canister 32 includes a lower mounting bracket 226 and an upper mounting bracket 228 facilitating its introduction and mounting within the system 20. A plate manifold 230 and an adjacent channel manifold 232 are provided to facilitate direction of fluid into and out of the canister. A barbed inlet hose fitting 234 and an adjacent barbed outlet hose fitting 236 are connected to the manifold arrangement 230 and 232. The direction of flow is depicted by the arrows in FIG. 17. An appropriate hose 238 can be mounted on each of the inlet and outlet fittings. In this manner, a fluid path is provided through the canister sections as shown. The rectangularly shaped canister 32 includes a backing plate 240 and a pair of side plate 242 and 244 to join with cover plate 212 and bottom and top plates 220 and 222 respectively to form the canister housing. A removable drain plug 246 is mounted in an aperture in the bottom plate 222 of the canister. Cover plate 212 is removably fixed in position by a plurality of screws 248. Activated carbon 250 is positioned in the interior of each canister section. Each upper screen assembly 224 also includes a secondary filter member in addition to the glass fiber screening material. All of the seams of the canister can be additionally sealed by an appropriate sealant such as a silicone rubber material.

Bowl assembly 38 is mounted in the lower housing and has an open upper end which is exposed or closed to the user depending upon the position of the seat and cover assembly 60. The seat and cover assembly 60 is shown in open position in phantom in FIG. 4. It is pivotable about pin 258 between the open and closed positions. The lower housing and accordingly the system is mounted in fixed position to the supporting structure 252, for example, on the interior of the deck of a boat. Suitable flange and bolt assemblies 254 on the base of the housing are provided for this purpose.

Bowl assembly 38 has an opening 256 in its bottom end for dumping of the waste contents. Opening 256 is normally closed by flush valve assembly 40.

A conventional flush ring surrounds the upper rim portion of the bowl assembly and the flush ring is conventionally connected for introduction of fluid to rinse the bowl and dilution of waste. This fluid adds in the transport of the waste material from the bowl through the flush valve 40 into the cassette 52 rinsing and cleaning the bowl and diluting the waste.

The cassette drive motor 62 is mounted to the interior of the lower housing and is interconnected with the cassette drive mechanism 48 by a suitable chain 260. Drive mechanism 48 includes a shaft 262 which removably engages and drives the triangular shaped take up roll 84 within the cassette. The motor and drive mechanisms are conventionally well known commercial products.

The pumps in the system including pumps 36 and 42 are commercially available products and are designed to pump the fluid through the system. This includes transporting the fluid from the reservoir to fill the toilet bowl after a flush and to rinse during a flush, transporting fluid from the filter cassette beneath the filter material in the cassette and placing it on top of the filter material to provide for recirculation, and transporting the fluid to the reservoir for storage. The fluid will be transported by gravity from the reservoir when it is in excess Alternatively, the effluent fluid can be transported by gravity to a holding tank near to the location of the system in those areas where effluent cannot be discharged to the environment. A simple reconnection of the effluent pipe to the holding tank instead of to the exterior of the support vehicle will accomplish this purpose.

All of the components to which fluid is to be directed at some time in operation of the system, are interconnected by appropriate conduits or hoses mounted to the introducing connectors to the elements. This would naturally include the toilet bowl assembly, the filter cassette, the reservoir, the coloring cell, the decoloring cell and the electrolytic cell. The decoloring cell or carbon canister is a common type of element used in waste disposal systems and is used for the purpose of removing color from the recirculated system fluid as well as providing fine filtration. The decoloring is achieved by activated carbon adsorption. The fine filtration is achieved through the "deep bed effect" of the carbon particles. Common commercial alternatives are acceptable as well for color removal and for fine filtration. The coloring cell is located in the toilet bowl flush circuit and functions to convert the slightly yellow tinted cloudy fluid into a masked blue solution to improve its aesthetic appearance in the bowl.

Filter cassette assembly 52 is removable from the housing for disposal and replacement. Prior to insertion of the housing, plug 172 is removed from cassette 52 exposing opening 154. The cassette is grasped by handle 132 and inserted into a receiving aperture 264 in the bottom front of the lower housing 26. Full insertion brings opening 154 in alignment with opening 256 in the bottom of the bowl assembly 38 and flush valve 40. In this manner waste dumped from the bowl will enter opening 154 into the interior of the cassette 52. The fluid disconnect 92 in the form of a female coupling is in position for interconnection with the fluid conduit system to remove fluid from the bottom chamber 159 of the cassette as it is being collected therein. The fluid is removed through tubular extension 160 in the bottom of the cassette. The solids take up roll 58 is a two piece arrangement with the triangular shaped outer piece 84 mounted on an interior shaft 266 which extends through an aperture in the side of the cassette and keys with shaft 262 attached to chain 260 coupled with the motor drive assembly 62. Drive mechanism 48 is designed to be easily and quickly coupled and uncoupled with the cassette as it is placed in position within the system to facilitate either drive and rotation of take up roll 58 or release for permitting removal of the cassette from the system.

Rotation of the take up roll 58 advances filter material within cassette 52 and collects solid waste thereabout. The supply rolls 142 and 144 are mounted in the casing in a spaced position from the take up roll 58. The rolls are positioned so that filter material from both of the supply rolls 142 and 144 will pass across the casing beneath entrance opening 154 and then will travel onto the take up roll for collection of the waste deposited through the entrance opening 154 onto the filter material.

Supply roll 142 contains a coarse filters material or screen material 54 which will first contact the waste discharged into the cassette and separate the majority of the solid particles contained therein. The other supply roll 144 includes a fine particle filter media 56 for secondary filtering of the waste material which is predominantly fluid that has passed through the screen filter material 54. Thus, fine filter media 56 provides a secondary filtering action. Both supply rolls 142 and 144 are rotatably mounted within the casing about suitable horizontal axes, are positioned adjacent to one another and substantially spaced from the take up roll 58. The coarse filter material 54 extends from the upper side of supply roll 142 and is supported intermediate its travel path by pressure plate 136. It then extends unsupported into direct engagement with the exposed surface of take up roll 58.

The fine filter media 56 from supply roll 144 takes a somewhat different path. It extends about roller guide 146 mounted beneath the supply roll 144 in the casing and then extends beneath screen material 54 over the portion of the cassette where waste material will travel through onto the filter. The filter table 140 then directs the fine filter media 56 onto the take up roll 58 with the coarse screen filter material 54 being captured between the outer surface of the roll 58 and the inner surface of the fine filter media 56. Filter table 140 is fixed in position in the cassette beneath the filter material and provides a further support for the fine filter media. In fact, after the take up roll enlarges through the storage of waste then comes into contact with filter table 140 which provides support and keeps it from sagging due to the weight of recirculated fluid. Filter table 140 includes a resilient cantilever end portion 268 to apply compression to the filter material being collected on the take up roll and support the exterior of the roll as it enlarges. Shaft 266 extending through the sides of the cassette are suitably journaled and sealed in a conventional manner to prevent leakage at those apertures in the casing of the cassette while facilitating rotation of the shaft and of the take up roll 58 therewith.

As previously stated, splash guard 148 is positioned adjacent the entrance opening 154 to the cassette to facilitate the prevention of waste material being dumped or splashed behind the filter supply rolls and instead being directed to the filtering portion of the screen material 54 and thereafter the secondary fine filtering media 56. Ribs 138 support filter table 140 at the forward end of cassette 52. Filter table 140 is constructed with parallel bars spaced apart with the opening therebetween permitting the passage of fluid. The space beneath the table 140 forms a chamber 159 for filtered fluid which can be immediately pumped from the cassette through tube 160. This avoids contamination caused by contact of the fluid with the take up roll containing the waste material should the cassette be vibrated or tilted as will often occur in a marine environment. Thus, the danger of leaching of waste solids and color is avoided.

The small amount of fluid collecting in the bottom of the cassette below the opening to tube 160 can be protected from contact with solid waste by the solid ribs 138 serving to entrap the fluid. Furthermore, an absorbent pad 158 can also be positioned in the bottom of the cassette to trap the small amount of fluid contained therein during non-use.

Cassette 52 can be locked in position within the housing by any conventional releasable latch mechanism which is easily accessible to the user. Release of the latch will permit the cassette to be removed from the housing after release of the fluid and electrical connections and the connections to the drive means. A cap 172 can then be placed over the access opening 154 and the cassette is completely sealed for disposal. A new cassette can be introduced in the same manner as described above in connection with the removed cassette. Thus, cassette 52 is handled in a quick and efficient manner without contamination and basically with a white glove procedure.

Figure 20:
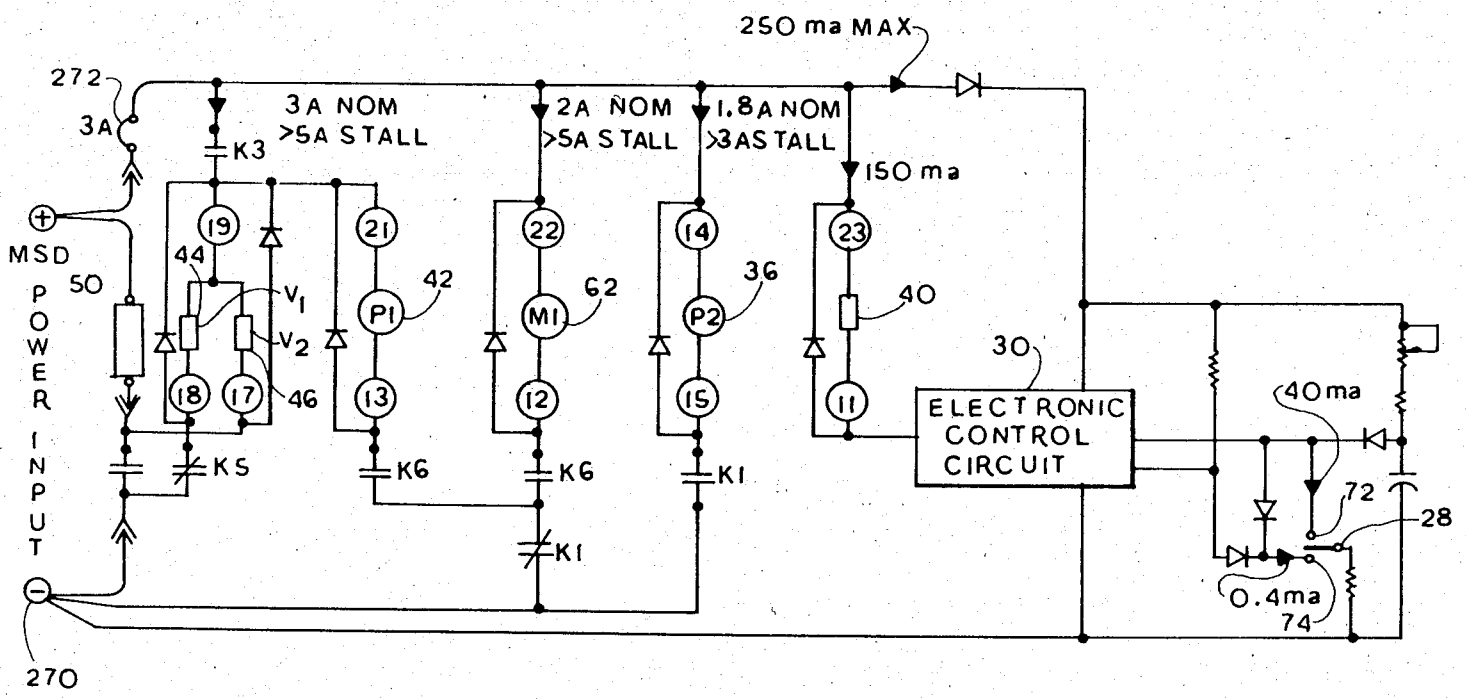
FIG. 20 is a schematic drawing of the electrical circuitry of the invention dealing with current distribution.
Figure 21:
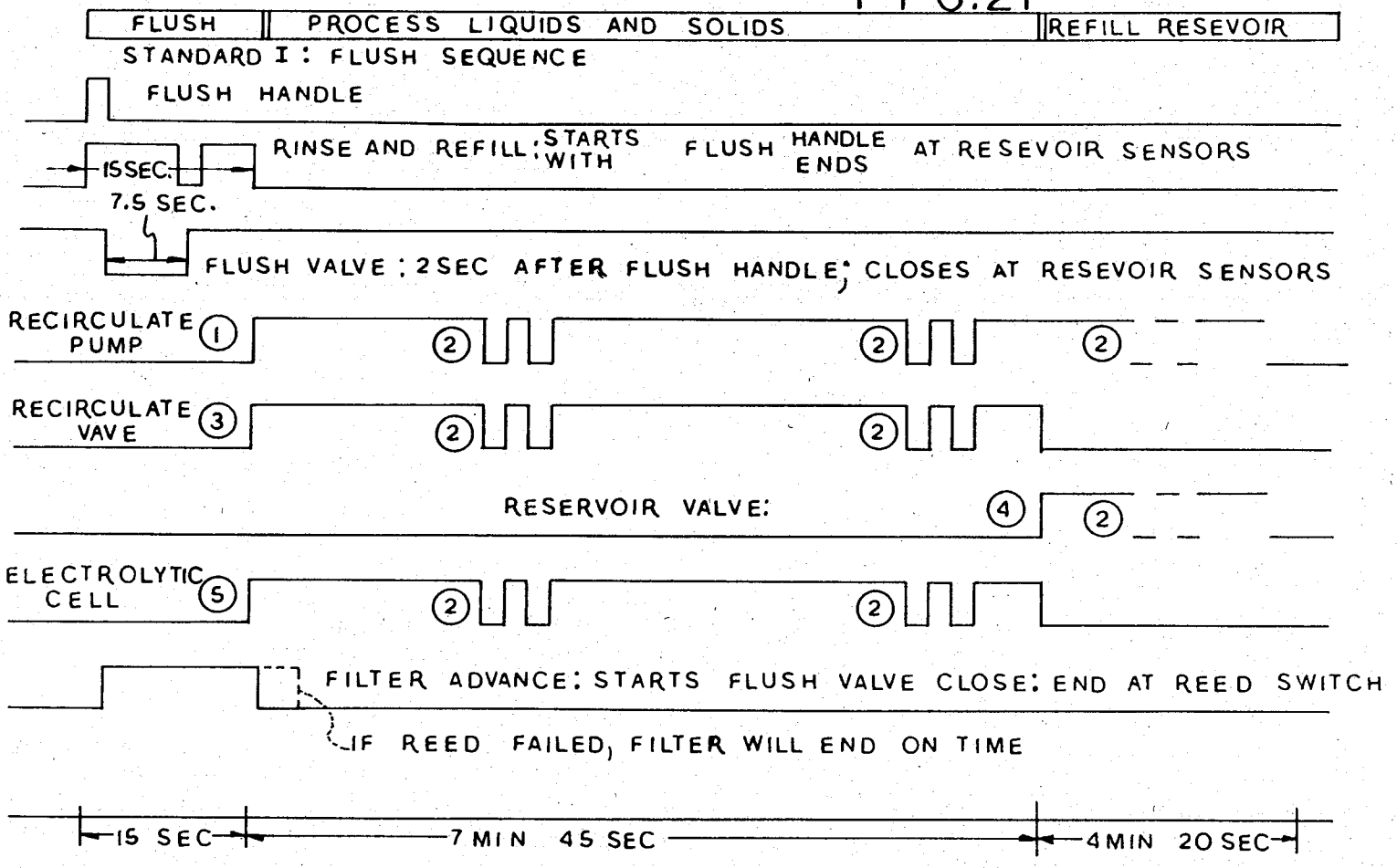
FIG. 21 is a schematic drawing of the flush sequence of the system.

Current distribution for the electrical controls is depicted in FIG. 20. The electronic control circuit 30 is actuated by control lever 28 which forms a two way switch for either a liquid flush or a solid flush. As previously described, if lever 28 is pushed upward it engages contact 72 and closes the circuit for a liquid flush and if it is pushed downward it engages contact 74 and closes the circuit for a solid flush. The electrical power imput 270 is a conventional type of power source such as a 12 volt battery. The electronic control circuit 30 controls the electromagnetic flush valve 40, rinse pump 36, recirculation pump 42, the filter advance motor 62, recirculation valve 44, the reservoir fill valve 46 and the sanitation module in the form of electrolytic cell 50. Appropriate conventional electrical connections are depicted in FIG. 20 for purposes of providing the necessary electrical current to operate the system as described in detail below.

Figure 22:
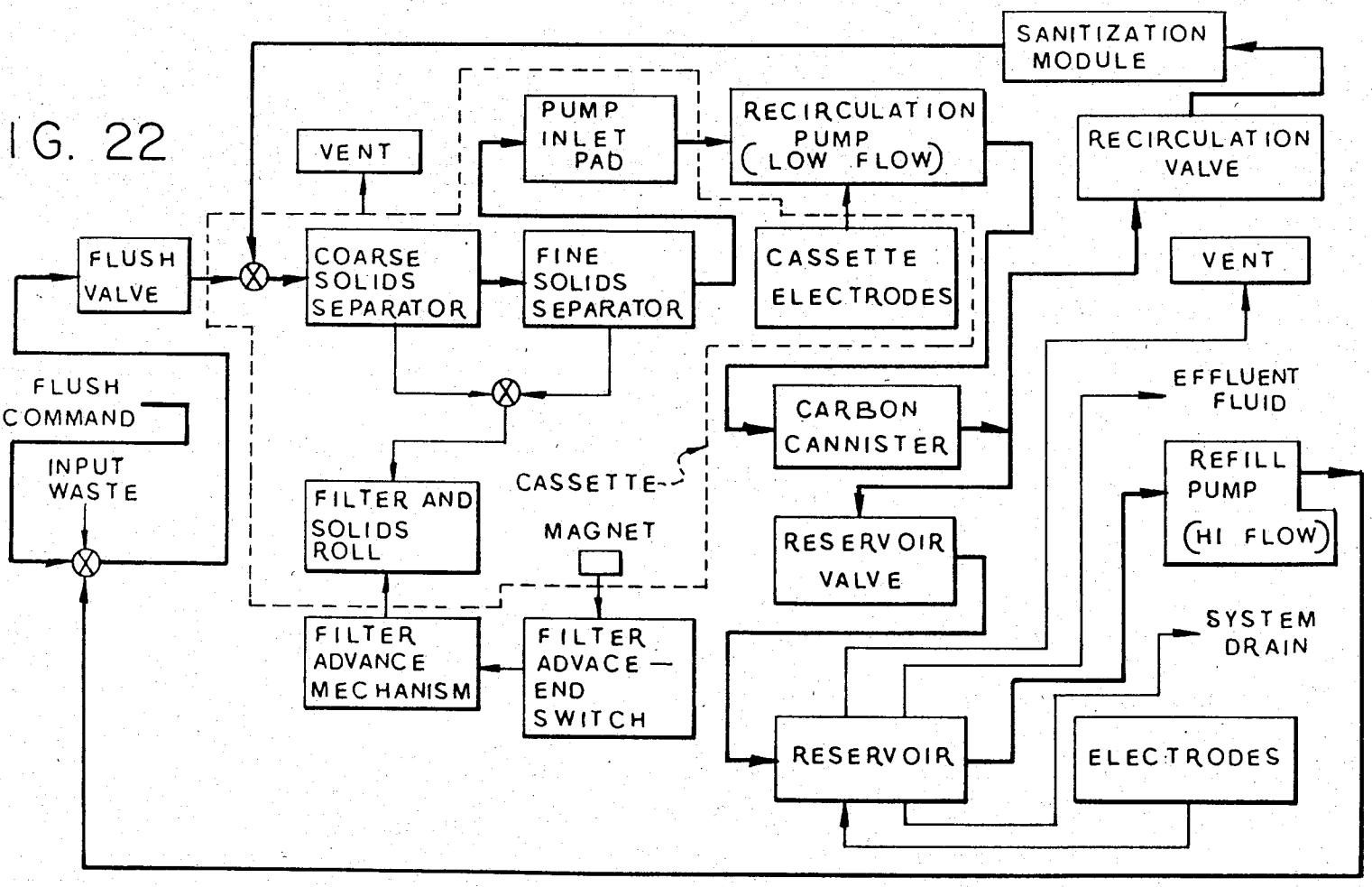
FIG. 22 is a block diagram of the sequence of operations of the system.
Figure 23A:
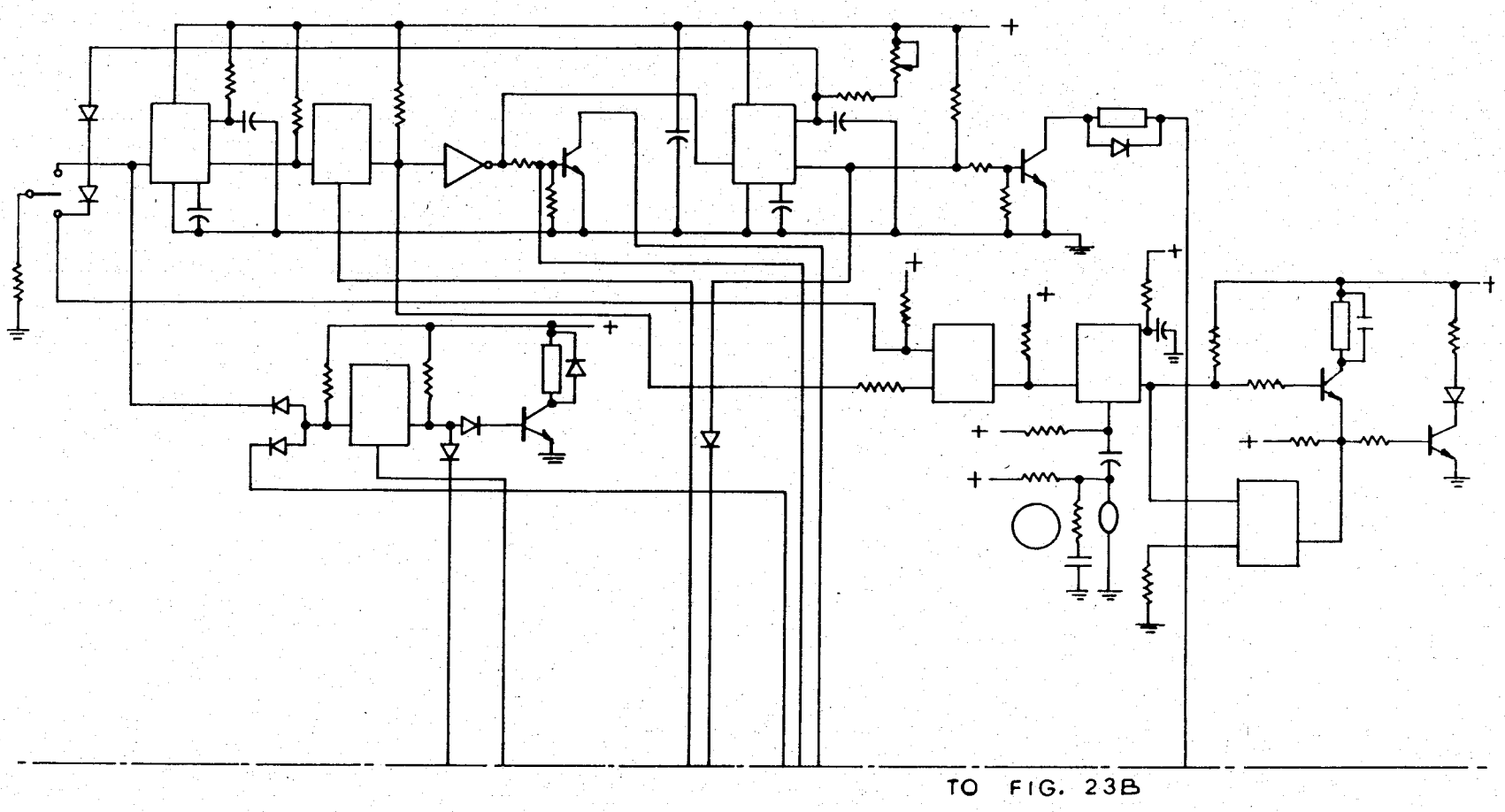
FIG. 23 A and B is a schematic drawing of the control circuits of the system.
Figure 23B:
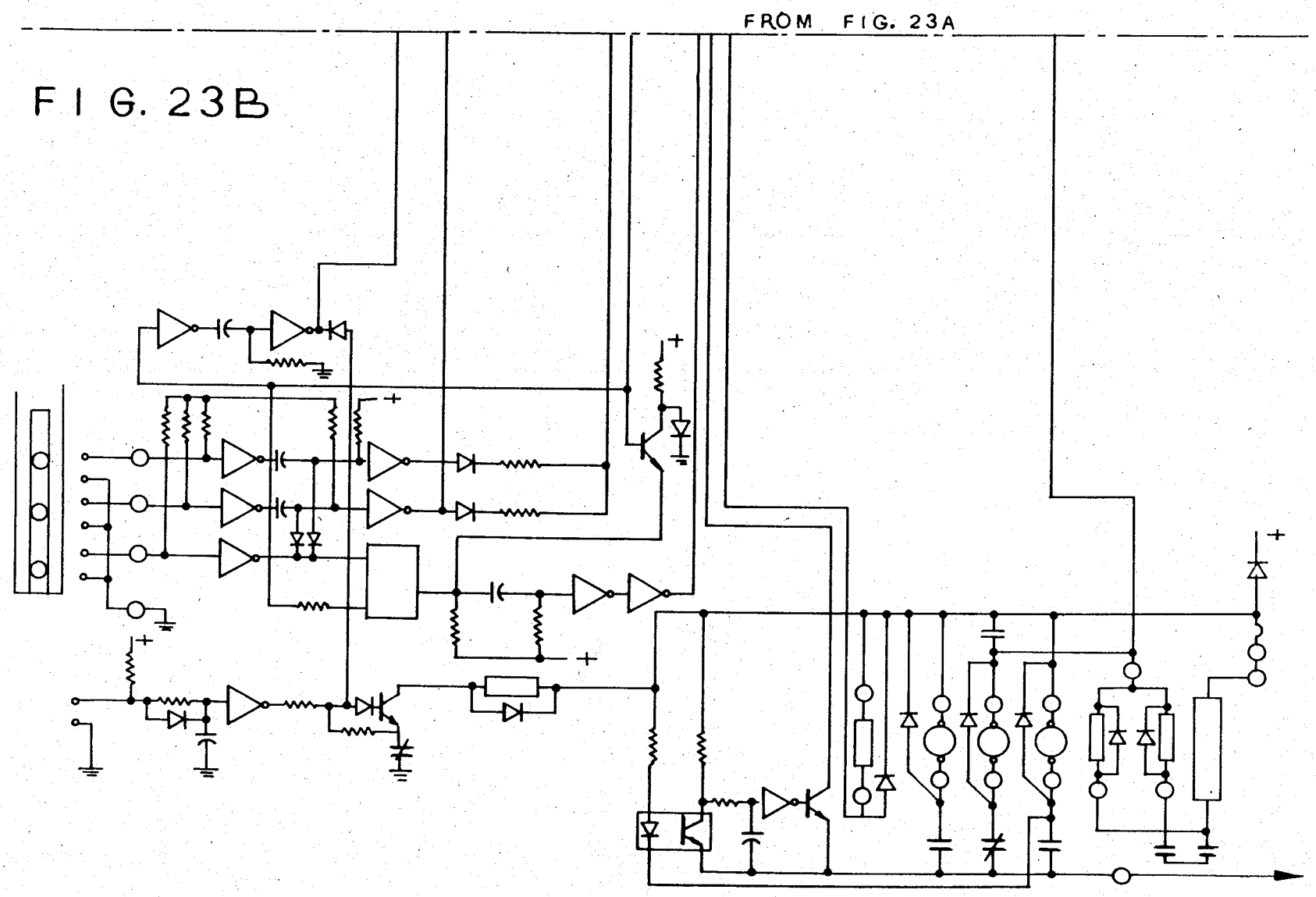

Suitable electrical controls including timers are interconnected in the control circuit shown in schematic form in FIG. 23. With this in mind and with reference to FIGS. 20, 21 and 22 and 23, the operation of the system will now be described.

The flush actuator or handle 28 is a two position switch. The conventional method of pushing down on the flush lever is used strictly for flushing solid waste. The alternate action of the flush handle is an upward motion. This is reserved for flushing liquid waste only. Toilet paper can be considered part of liquid waste. Each position starts the flush cycle, however, only the downward position advances the filter material in the cassette for solids removal. Otherwise the filter advance motor 62 is not activated and the filter material in the cassette is not advanced. In either event, the contents dumped from the bowl whether liquid only or liquid and solids is processed in the manner indicated in the flush sequence shown in FIG. 21. Appropriate timing mechanisms are employed to activate the various components and the total time of the sequence is 12 minutes and 20 seconds as shown on the bottom line of FIG. 21. As shown in FIG. 22, the imput waste in bowl 38 is discharged by a signal from the actuation of lever 28 either upward or downward to respectively contact 72 or 74. This provides a flush command which de-energizes flush valve coil 184 permitting the flapper 180 to open and allowing the bowl content to drop into the interior of the cassette 52 and provide a rinsing action. The flush valve is timed to open two seconds after flush handle or lever 28 is operated. It remains open for 7.5 seconds thereby permittinq the bowl to be emptied and rinsed. After the flush valve 40 closes, the timing cycle energizing the electrolytic cell 50 is started but not made until the sump electrodes are covered with fluid.

At the time the lever 28 is depressed, the rinse and refill pump 46 is also energized. For approximately 7.5 seconds it provides rinsing fluid into the bowl through the flush ring while the flush valve 40 is still open. When the fluid level in the reservoir is reduced to a predetermined level, the reservoir sensors re-energize the coil of the flush valve 40 and the flush valve closes. Thereafter for another approximate 7.5 seconds, pump 36 continues to supply fluid to the bowl to refill the bowl to a predetermined level as determined by the reservoir sensors again indicating a lower level of fluid in the reservoir. In this manner, the toilet bowl is refilled with clean recycled fluid. The rinse and refill pump 36 controls the flow of fluid so that in the first approximate 7.5 seconds fluid is provided to the flush ring for rinsing purposes and for the second approximate 7.5 seconds fluid is directed to the reclosed flush valve for entry into the bowl for refilling purposes.

During the time that the bowl is being rinsed and refilled, the waste material which has entered the cassette is filtered by the coarse and fine layers of filtered material lying one above the other. The waste first contacts the coarse screen material 54 whereupon the majority of the solid waste material, if any is present is removed. The fluid is then passed to the fine filter media 56 where the fluid is further filtered and any further solid material is also removed. The remaining filtered fluid collects in the bottom sump 159 of the cassette. If a solid flush cycle has been started by depressing the lever 28 downward, the filter advance mechanism will be actuated and the take up roll will be advanced for a predetermined time to collect the solid material on the triangular shaped take up roll 84 and surrounded by collected layers of coarse screen filter material 54 and fine filter media 56. An appropriate reed switch is provided to limit the amount of filter advance and incorporated in a conventional manner in the circuitry. As a safeguard to failure of the reed switch, the filter advance mechanism will end a short period of time after the 15 second period.

After the 15 second time period for rinse and refill ends, the electrolytic cell 50 will be energized as well as recirculation valve 44 and recirculation pump 42. This initiates the sequence for processing the liquids and solids. The recirculation pump 42, electrolytic cell and valve will only be energized when the sensing electrodes 174 in the sump portion 159 of the cassette are wet. The recirculation pump 42, stops when electrodes 174 in the cassette become dry. In fact, when the electrodes become dry the recirculation valve 44 and the electrolytic cell 50 will also interrupt. All three interrupted elements will restart when electrodes 174 become wet again. This sequence of recirculation proceeds for a predetermined length of time, namely 7 minutes and 45 seconds. During this period of time, filtered fluid is pumped through fluid pick up 160 in the cassette through the carbon canister 32 for further filtration and decoloring, then through the sanitation module or electrolytic cell 50 for further sanitizing and deodorizing action and then back into the upper access opening 154 to the cassette for recycling through the filter material therein. In this manner, the fluid is continuously recycled for the 7 minutes and 45 seconds time period and is continuously being refiltered and processed.

When the process time elapses, the recirculation valve 44 closes and the reservoir valve 46 is energized to open. The electrolytic cell is also de-energized at the same time the recirculation valve 44 is de-energized. As long as the sump electrodes 174 are still wet, the recirculation pump 42 continues to operate and with the reservoir valve 44 now open, the filtered fluid is directed into the reservoir to refill the reservoir. This refilling action continues unless the sump electrodes 174 become dry at which time both the recirculation pump and reservoir valve will interrupt. When the sump electrodes 174 become wet again, the recirculation pump and the reservoir valve will again direct fluid to continued refilling of the reservoir. This condition will remain in effect until a subsequent flush. However, a typical pumping time in this mode may be up to 4 minutes and 20 seconds.

When effluent fluid becomes in excess, it will enter effluent tube 128 and be discharged by gravity from the system to the effluent discharge conduit. An appropriate vent is also provided for the reservoir and the entire reservoir can be interconnected with a drain system for draining the system at a desired time. Alternatively, the effluent fluid conduit can be interconnected with a holding tank so that as excess fluid is accumulated in the reservoir it will be directed to the holding tank by gravity instead of being discharged to the environment.

As stated, if the flush handle 28 is depressed to make contact with contact 74, to achieve "solid flush", both the main cycle timer and the filter advance timer portions of a conventional dual solid state timer are energized. The main cycle timer portion functions in the same manner as previously described. The filter advance portion of the timer causes the filter advance control relay to be energized after the bowl is refilled. This in turn energizes the filter advance drive motor. The drive motor advances the filter material in the filter cassette 52 by approximately 6 inches. Any solid waste collected on the filter material is rolled up in the take up roll.

While this is occurring the filter change signal light is incapable of being energized. In order to verify and detect proper advancement of the filter material, a system is devised whereby a tiny amount of magnetic material 170 is implanted in the end of the filter supply roll 142 located within filter cassette 52. As the filter supply roll 142 rotates to supply filter material 54 to the take up roll 58, the magnet 170 will be sensed by an appropriate electrical or reed switch in the circuitry. When the magnet 170 moves within close proximity of the reed switch, a relay will be de-energized thereby causing the filter advance motor to stop. If the filter media detaches from the filter suppl roll, or the filter material becomes depleded, or the filter does not advance completely in a predetermined time, the magnet 170 will not come in close proximity to the reed switch and thereby not de-energize the relay in the prescribed time period, and consequently illuminating the filter change light. This light tells the operator to install a new filter cassette.

In order to have a filter cassette changed the operator disengages the cassette filter drive mechanism 48. Cassette 52 can then be removed and a new cassette installed in the simple and efficient manner described above.

Replacement of the decoloring or carbon canister 32 can be accomplished at the same time as the filter cassette replacement. After the new cassette and canister are in place approximately 1 quart of water should be added to the bowl to make up for the fluid lost in the transfer. The control power circuit breaker 272 should be turned off to reset the filter change light and immediately restored in order to make a solid flush command to put the unit into a "ready" condition.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A method for disposing of sewage waste within a self-contained system comprising the steps of: providing a toilet bowl capable of receiving human waste and fluid for diluting the waste, placing a removable filter cassette in alignment and in communication with the toilet bowl, flushing the bowl and dumping the contents into the filter cassette, filtering the fluid in the filter cassette and separating coarse and fine particles of solid material from the fluid received from the bowl, storing the solid material in a compact manner in the cassette for subsequent disposal upon removal of the cassette from alignment with the toilet bowl, locating a reservoir exteriorly of the cassette and interconnected with the cassette in a manner which provides for the immediate removal of filtered fluid to the reservoir after separation from the solid material, transporting fluid through interconnected conduits to fill the bowl after a flush, to transport filtered fluid from the filter cassette to a position for recirculation and after recirculation, to the reservoir for storage and reuse, and removing and controlling the passage of fluid in a predetermined sequence to facilitate the collection and disposal of sewage waste including immediate removal of filtered material from the cassette to the reservoir for storage and reuse thereof in the next operational sequence without danger of contactings the storage material in the cassette.

2. The invention in accordance with claim 1 wherein means is provided positioned in the housing for sanitizing deodorizing the recirculated fluid.

3. The invention in accordance with claim 1 wherein the cassette is provided with a configuration facilitating the use of a minimum amount of space within the housing and so that fluid filtered therein is separated from the solid waste being collected therein and in position for ease of removal from the cassette.

4. The invention in accordance with claim 1 wherein a sensing means is provided to sense an accumulation of predetermined amount of filtered fluid in the cassette to actuate a pump to transfer the fluid from the cassette to the reservoir through the interconnected conduits.

5. The invention in accordance with claim 1 wherein flush valve means is provided to maintain the fluid in the bowl, dump the bowl upon a flush command and subsequently permit the refilling of the bowl with fresh recycled fluid.

6. The invention in accordance with claim 1 wherein a recirculation valve means is provided to be actuated after the bowl is refilled to recirculate filtered fluid within the system for further treatment for a predetermined period of time, and a refill valve means is provided to permit fluid to enter and refill the reservoir at a predetermined time.

7. The invention in accordance with claim 1 wherein the fluid filtered in the cassette is further treated by passing it through a fine filtering and decoloring means.

8. The invention in accordance with claim 7 wherein the fine filtering and decoloring means is a carbon canister.

9. The invention in accordance with claim 1 wherein control means is provided which includes a flush actuator and a flush valve, a rinse and refill pump means responsive to actuation of the flush handle to cooperate with the flush valve in rinsing and refilling the toilet bowl and, reservoir sensing means responsive to emptying of the reservoir and refilling of the bowl to close the flush valve at a predetermined time, the pump means further including a recirculation pump and the control means further including a recirculation valve responsive to completion of the rinse and refill of the toilet bowl to operate and provide for recirculation of fluid through the system for a perdetermined time, and the control means including a reservoir valve which is activated at a predetermined time permitting the refilling of the reservoir and deactivated when the cassette becomes substantially dry of fluid.

10. The invention in accordance with claim 9 wherein means is provided in the housing for sanitizing and deodorizing the recirculated fluid and which is activated upon the activation of the recirculation valve and terminates operation upon the deactivation of the recirculation valve.

11. The invention in accordance with claim 10 wherein the means in the housing for sanitizing and deodorizing the recirculation fluid includes an electrolytic cell for converting the chloride normally found in human urine into different chlorine compounds.

12. The invention in accordance with claim 1 wherein the filter cassette includes a casing mounted in alignment with a discharge opening in the toilet bowl and having an opening therein in communication therewith, a supply of filter material in the cassette, take up means in the cassette in position to draw filter material from the filter supply into alignment with the opening in the cassette to receive and filter sewage waste from the toilet bowl and then to collect and store the filter material and accumulated solid waste material within the cassette.

13. The invention in accordance with claim 12 wherein the cassette includes take up means having a take up roll connectable to the control means for rolling up a predetermined portion of filter material and collected solid waste upon demand.

14. The invention in accordance with claim 13 wherein the take up roll has polygonal configuration to facilitate collection of the filter material and collected solid waste.

15. The invention in accordance with claim 12 wherein the filter material includes a first sheet of screen material having a porosity to collect the larger particles of solid water and a second sheet of filter media positioned adjacent the first sheet of screen material to receive the fluid and smaller particles of solid waste passed therethrough and the fluid is further filtered to remove additional solid waste material.

16. The invention in accordance with claim 15 wherein the first sheet of screen material extends from a supply roll across the cassette onto the take up roll and the second sheet of filter media extends from a second supply roll across the cassette and onto the take up roll, the first sheet of screen material and the second sheet of filter media being one above the other in alignment with the opening in the upper side of the cassette which is aligned with the discharge opening in the toilet bowl.

* * * * *

UNITED STATES PATENT AND TRADEMARK OFFICE

CERTIFICATE OF CORRECTION

PATENT NO. : 4,585,562

DATED : April 29, 1986

INVENTOR(S) : De Graw, et al.

It is certified that error appears in the above-identified patent and that said Letters Patent is hereby corrected as shown below:

Column 1, line 15, after "159", insert --.--

Column 1, line 19, after "fecal", delete "u"

Column 1, line 20, after "per", delete "10" and insert --100--

Column 1, line 32, after "11-12-81" insert --.--

Column 4, line 25, after "dumping", delete "u"

Column 5, line 67, delete "electrohic" and insert --electronic--

Column 7, line 44, delete "casino" and insert --casing--

UNITED STATES PATENT AND TRADEMARK OFFICE

CERTIFICATE OF CORRECTION

PATENT NO. : 4,585,562

DATED : April 29, 1986

INVENTOR(S) : De Graw, et al.

It is certified that error appears in the above-identified patent and that said Letters Patent is hereby corrected as shown below:

Column 10, line 26, after "excess" insert --.--

Column 11, line 20, delete "filters" and insert --filter--

Column 14, line 65, delete "suppl" and insert --supply--

Signed and Sealed this

*Twenty-sixth* Day of *August 1986*

[SEAL]

*Attest:*

DONALD J. QUIGG

*Attesting Officer*

*Commissioner of Patents and Trademarks*